US008246359B2

(12) United States Patent
Sloey et al.

(10) Patent No.: US 8,246,359 B2
(45) **Date of Patent: *Aug. 21, 2012**

(54) MULTI-PIN CONNECTOR FOR ADVANCED SIGNALING

(75) Inventors: Jason Sloey, San Jose, CA (US); S. Brian Lynch, Portola Valley, CA (US); Stephen Paul Zadesky, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/008,761

(22) Filed: Jan. 18, 2011

(65) Prior Publication Data

US 2011/0111642 A1 May 12, 2011

Related U.S. Application Data

(63) Continuation of application No. 12/569,502, filed on Sep. 29, 2009.

(60) Provisional application No. 61/101,151, filed on Sep. 30, 2008.

(51) Int. Cl.
*H01R 12/00* (2006.01)

(52) U.S. Cl. ..... 439/76.1; 439/660

(58) Field of Classification Search ..... 439/660, 439/76.1

See application file for complete search history.

(56) References Cited

U.S. PATENT DOCUMENTS 5,772,474 A 6/1998 Yagi et al.
5,871,378 A 2/1999 Poiraud et al.
5,902,136 A 5/1999 Lemke et al.
5,984,725 A 11/1999 Belopolsky et al.
6,176,748 B1 1/2001 Simmel et al.
6,371,771 B1 4/2002 Fan
6,485,315 B1 11/2002 Hwang
6,589,077 B1 * 7/2003 Wu ..... 439/567
6,609,933 B2 8/2003 Yamasaki
6,663,406 B1 12/2003 Wu (Continued)

FOREIGN PATENT DOCUMENTS

CN 201113086 Y 9/2008

(Continued)

OTHER PUBLICATIONS

Office Action mailed Aug. 18, 2011 in U.S. Appl. No. 12/569,502, 16 pages.

(Continued)

*Primary Examiner* — Renee S. Luebke
*Assistant Examiner* — Larisa Tsukerman
(74) *Attorney, Agent, or Firm* — Kilpatrick Townsend & Stockton LLP

(57) ABSTRACT

Receptacle connectors and male plug connectors having a reduced size in at least one direction can be provided. One example reduces height by not including a center contact tab or tongue, but instead places contacts on an insulator that is adjacent to a bottom portion of the receptacle. Another example may reduce width by reducing contact pitch, and may use a particular shape of contact to achieve god signal quality. Receptacle connectors and male plug connectors can also provide support for one or more new high-speed communication standards, such as USB 3.0 and DisplayPort. Methods can provide one or more standardized connector components to speed connector design and manufacture of new electronic devices such as media players, thus reducing their time to market.

20 Claims, 18 Drawing Sheets

U.S. PATENT DOCUMENTS

| | | | | |
|---|---|---|---|---|
| 6,705,893 | B1 * | 3/2004 | Ko | 439/607.56 |
| 6,709,286 | B1 | 3/2004 | Korsunsky et al. | |
| 6,796,839 | B1 * | 9/2004 | Wu | 439/607.01 |
| 6,945,824 | B1 | 9/2005 | Li et al. | |
| 6,948,983 | B1 | 9/2005 | Peng | |
| 7,201,614 | B2 | 4/2007 | Cheng et al. | |
| 7,258,565 | B2 | 8/2007 | Huang et al. | |
| 7,329,153 | B2 * | 2/2008 | Lin et al. | 439/660 |
| 7,440,287 | B1 | 10/2008 | Ni et al. | |
| 7,789,716 | B2 | 9/2010 | Fedder et al. | |
| 2001/0010983 | A1 | 8/2001 | Bricaud et al. | |
| 2003/0100203 | A1 | 5/2003 | Yen | |
| 2003/0129879 | A1 | 7/2003 | Casey | |
| 2004/0145875 | A1 | 7/2004 | Yu et al. | |
| 2004/0224638 | A1 * | 11/2004 | Fadell et al. | 455/66.1 |
| 2007/0004282 | A1 | 1/2007 | Cohen et al. | |
| 2007/0117459 | A1 | 5/2007 | Chen | |
| 2007/0141915 | A1 | 6/2007 | Kim | |
| 2008/0014771 | A1 | 1/2008 | Ni et al. | |
| 2008/0155824 | A1 | 7/2008 | Sprouse et al. | |
| 2008/0305690 | A1 | 12/2008 | Zhang et al. | |
| 2009/0053932 | A1 | 2/2009 | Zhou et al. | |
| 2009/0088024 | A1 | 4/2009 | Ling et al. | |
| 2009/0137157 | A1 * | 5/2009 | Swanger et al. | 439/655 |
| 2009/0179883 | A1 * | 7/2009 | Goodart et al. | 345/211 |
| 2010/0095031 | A1 | 4/2010 | Shen et al. | |

FOREIGN PATENT DOCUMENTS

| | | | |
|---|---|---|---|
| EP | 1065758 | A2 | 1/2001 |
| EP | 1227428 | A | 7/2002 |
| EP | 1453146 | A | 9/2004 |
| WO | WO 00/51206 | A | 8/2000 |

OTHER PUBLICATIONS

Office Action mailed Apr. 4, 2012 in U.S. Appl. No. 12/569,502, 20 pages.

Search/Examination Report dated Feb. 1, 2010 from GB Patent Application No. GB0917064.8, 5 pages.

Search/Examination Report dated Oct. 11, 2010 from GB Patent Application No. 0917064.8, 2 pages.

Search/Examination Report dated Mar. 17, 2010 from International Application No. PCT/US2009/058811, 22 pages.

Search/Examination Report dated Sep. 7, 2010 from Australian Patent Application No. 2010100663, 2 pages.

"Common Interconnection for Portable Media Players"; Jul. 2007, *ANSI/CEA-2017*, 30 pages.

"Serial Communication Protocol for Portable Electronic Devices"; *ANSI/CEA-2017.1*, 102 pages, Nov. 2007.

Search/Examination Report dated Feb. 18, 2011 from Australian Patent Application No. 201110083, 2 pages.

"CEA Standards Update" Jun. 30, 2008, Retrieved from the internet on Feb. 16, 2011 <URL: http://www.ce.org/Standards/2008-06-30CEAStandardsMonthlyUpdate.pdf>, 6 pages.

"CEA may spawn standards effort for handhelds"; Jul. 10, 2008, retrieved from the internet on Feb. 16, 2011 ,URL: http://www.eetimes.com/electronics-news/4077834/CEA-may-spawn-standards-effort-for-handhelds>, 2 pages.

* cited by examiner

FIG. 6B

| 30P 2.0 Single Channel DP | |
|---|---|
| Pin | Function |
| 1 | GND |
| 2 | USB3 Tx + |
| 3 | USB3 Tx - |
| 4 | GND |
| 5 | USB3 Rx + |
| 6 | USB3 Rx - |
| 7 | GND |
| 8 | USB2 D + |
| 9 | USB2 D - |
| 10 | GND |
| 11 | DP 0 + |
| 12 | DP 0 - |
| 13 | GND |
| 14 | DP AUX + |
| 15 | DP AUX - |
| 16 | GND |
| 17 | DP HP DETECT |
| 18 | USB 5V |
| 19 | GND / IPOD PRESENT |
| 20 | ACC ID |
| 21 | ACC 3V |
| 22 | PWR RTN |
| 23 | TX TO IPOD |
| 24 | RX FROM IPOD |
| 25 | REMOTE SENSE |
| 26 | ACC DETECT |
| 27 | COMPOSITE VIDEO |
| 28 | AUDIO RET |
| 29 | LINE OUT L |
| 30 | LINE OUT R |
| 31 | SHELL |
| 32 | SHELL |

650

FIG. 6C

| 30P 2.0 Dual Channel DP | |
|---|---|
| Pin | Function |
| 1 | GND |
| 2 | USB3 Tx + |
| 3 | USB3 Tx - |
| 4 | GND |
| 5 | USB3 Rx + |
| 6 | USB3 Rx - |
| 7 | GND |
| 8 | USB2 D + |
| 9 | USB2 D - |
| 10 | GND |
| 11 | DP 0 + |
| 12 | DP 0 - |
| 13 | GND |
| 14 | DP 1 + |
| 15 | DP 1 - |
| 16 | GND |
| 17 | DP AUX + |
| 18 | DP AUX - |
| 19 | GND / IPOD DETECT |
| 20 | ACC DETECT |
| 21 | DP HP DETECT |
| 22 | GND |
| 23 | ACC ID |
| 24 | ACC 3V |
| 25 | GND |
| 26 | TX TO IPOD |
| 27 | RX FROM IPOD |
| 28 | PWR RTN |
| 29 | USB 5V |
| 30 | NC |
| 31 | SHELL |
| 32 | SHELL |

660

690

| 11P 2.0 Dual Channel DP | |
|---|---|
| Pin | Function |
| 1 | USB 5V ** |
| 2 | GND |
| 3 | USB D + |
| 4 | USB D - |
| 5 | GND |
| 6 | OTG |
| 7 | Acc 3V |
| 8 | LINE OUT L |
| 9 | LINE OUT R |
| 10 | A/V RET |
| 11 | COMPOSITE VIDEO |
| 12 | SHELL |
| 13 | SHELL |
| Optional | |
| OL1 | Optical Link for Digital A/V |
| OL2 | Optical Link for Digital A/V |

FIG. 6F

| Mating Sequence | Wipe |
|---|---|
| 1st | 1.0 mm |
| 2nd | 1.0 mm |
| 3rd | 0.5 mm |

FIG. 6G

| 18P 2.0 Dual Channel DP | |
|---|---|
| Pin | Function |
| 1 | USB 5V ** |
| 2 | GND |
| 3 | USB D + |
| 4 | USB D - |
| 5 | GND |
| 6 | OTG |
| 7 | Acc 3V |
| 8 | LINE OUT L |
| 9 | LINE OUT R |
| 10 | A/V RET |
| 11 | DP 0 + |
| 12 | DP 0 - |
| 13 | GND |
| 14 | DP 1 + |
| 15 | DP 1 - |
| 16 | DP AUX + |
| 17 | DP AUX - |
| 18 | DP HP DETECT |
| 19 | SHELL |
| 20 | SHELL |

680

FIG. 6E

| 30P 2.0 Quad Channel DP | |
|---|---|
| Pin | Function |
| 1 | GND |
| 2 | USB3 Tx + |
| 3 | USB3 Tx - |
| 4 | GND |
| 5 | USB3 Rx + |
| 6 | USB3 Rx - |
| 7 | GND |
| 8 | USB2 D + / DP AUX + * |
| 9 | USB2 D - / DP AUX - * |
| 10 | GND |
| 11 | DP 0 + |
| 12 | DP 0 - |
| 13 | GND |
| 14 | DP 1 + |
| 15 | DP 1 - |
| 16 | GND |
| 17 | DP 2 + |
| 18 | DP 2 - |
| 19 | GND |
| 20 | DP 3 + |
| 21 | DP 3 - |
| 22 | GND |
| 23 | TX TO IPOD |
| 24 | RX FROM IPOD |
| 25 | GND / IPOD PRESENT |
| 26 | ACC DETECT |
| 27 | DP HP DETECT |
| 28 | PWR RTN |
| 29 | USB 5V ** |
| 30 | ACC ID |
| 31 | SHELL |
| 32 | SHELL |

FIG. 6D

670

* DP AUX shares pins with USB 2.0 D+/-
** Step down 5V on ACC side

MULTI-PIN CONNECTOR FOR ADVANCED SIGNALING

CROSS-REFERENCE TO RELATED APPLICATIONS

This application is a continuation of U.S. patent application Ser. No. 12/569,502 entitled "Reduced Size Multi-Pin Female Receptacle Connector" by Sloey et al., which claimed priority to U.S. provisional application No. 61/101,151, filed Sep. 30, 2008, titled "Reduced Size Multi-Pin Connector," which are incorporated by reference. This application is also related to commonly owned and concurrently filed U.S. patent application Ser. No. 12/569,448 entitled "Reduced Size Multi-Pin Male Plug Connector" by Sloey et al., the disclosure of which is incorporated by reference in its entirety.

BACKGROUND

Electronic devices such as media players and related devices have become ubiquitous over the past several years. As they have proliferated, the types and styles of electronic devices have diversified. During this time, a theme has been that consumers want more functionality packed into an ever-decreasing form factor.

At the same time, many new high-speed communication standards have been developed. Examples of these new standards include the new high-speed USB3, DisplayPort, and others. Although it is desirable to have an electronic device such as a media player be able to use these new high-speed communication standards, these new standards are often tough to meet. Meanwhile, it is also desirable that electronic devices be able to also communicate using conventional signaling such as analog audio and video.

Also, as the styles and types of electronic devices such as media players are expected to continue to multiply, it is desirable that these new styles and types be able to be introduced quickly to the marketplace.

SUMMARY

Accordingly, various embodiments of the present invention can provide male plug connectors and female receptacle connectors that may have a reduced size in at least one direction. Some embodiments of the present invention can provide support for one or more new high-speed communication standards. Further embodiments of the present invention can provide one or more standardized connector components to speed connector design and manufacture of new electronic devices such as media players, thus reducing their time to market. These electronic devices may range from smaller hand-held devices, which may include portable media players, to larger devices, such as laptop or desktop computers.

An embodiment of the present invention may provide a receptacle connector having a reduced height. The receptacle connector can include a shell, an insulator core, and a cavity configured to receive the male plug connector. The shell can have a top, a bottom, a first side, a second side opposite the first side, and an opening at a front of the receptacle connector. The insulator core can have a bottom surface that is adjacent with an inner surface of the bottom of the shell. A plurality of locations can be spaced apart in a single row and located on a top surface of the insulator core. The cavity can include a first region between the top surface of the insulator core and the top of the shell and a second region between sides of the insulator core and the sides of the shell.

Another embodiment of the present invention may provide a receptacle connector having a reduced width. The width may be reduced by reducing a width of contacts or spacing between contacts, or both. The contacts may have a first section located within an insulator core. The first section of at least one contact can have sides that are substantially parallel to each other except for one or more recesses. High-speed data communications may be achieved with such a contact, with or without a reduced width of the connector.

Another embodiment of the present invention may provide a receptacle connector that can include an insulator core and a plurality of contact locations spaced apart in a single row and located on a first surface of the insulator core. The contact locations can include a first portion of contact locations designated for ground and a second portion of contact locations designated for carrying signals. The contact locations of the first portion can be separated from each other by two contact locations of the second portion.

Another embodiment of the present invention may provide a method of manufacturing a plurality of receptacle connectors for a variety of types of media players. A plurality of substantially identical insulating cores, each insulating core including a plurality of contacts, can be provided. A plurality of types of shells can also be provided. Each shell can be configured to attach to any one of the plurality of insulating cores, and each type of shell can be configured to be used in the assembly of a different type of media player. For each of the plurality of substantially identical insulating cores, one of the plurality of types of shells can be selected, and the selected shell can be attached to the respective insulating core.

Various embodiments of the present invention may incorporate one or more of these and the other features described herein. A better understanding of the nature and advantages of the present invention may be gained by reference to the following detailed description and the accompanying drawings.

BRIEF DESCRIPTION OF THE DRAWINGS

FIGS. 6B-6F show examples of contact designations (pinouts) for receptacle connectors and corresponding male plug connectors according to embodiments of the present invention.

FIG. 6G illustrates a mating sequence and wiping distance of pinouts according to embodiments of the present invention.

DETAILED DESCRIPTION

Certain embodiments can provide connectors having a reduced size in at least one dimension, which can allow electronic devices using such connectors to be reduced in size. Some embodiments can provide connectors that can support communication using one or more of high-speed interface standards, where such standards can include a restriction on an amount of cross-talk between signals and impedance of contacts. Embodiments can also provide one or more components of the connector that are standardized or generic such that they can be used in different styles and types of electronic devices (such as media players).

Figure 1:
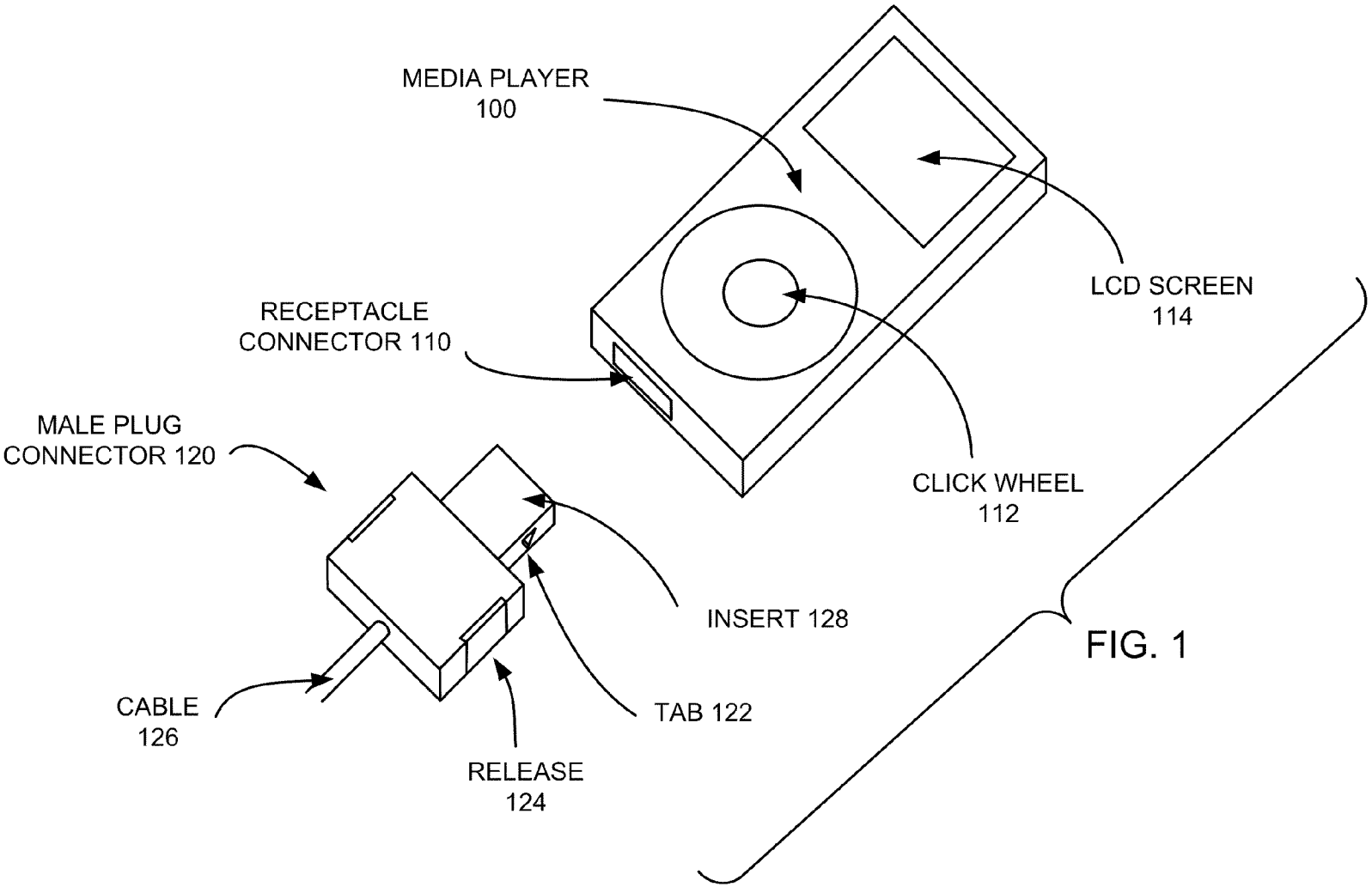
FIG. 1 is a simplified perspective view of a representative media player and male plug connector (neither of which are drawn to scale) that may be improved by the incorporation of embodiments of the present invention.

FIG. 1 is a simplified perspective view of a representative media player 100 and male plug connector 120 (neither of which are drawn to scale) that may be improved by the incorporation of embodiments of the present invention. Media player 100 may have an LCD screen 114 for viewing and a click wheel 112 for control. Other embodiments may include a touch screen, keyboard, or other interface components (not shown).

Media player 100 includes a receptacle connector 110 into which an insert 128 of a male plug connector 120 can be inserted. In this example, receptacle connector 110 is shown as having an insert 128 that is square, though in other embodiments it may be rounded or have other shapes. Insert 128 may include connector tabs 122 on one or more sides (tabs may also be on a top or bottom) that fit into slots on receptacle connector 110 to prevent accidental removal of insert 128 from receptacle connector 110. To remove insert 128, connector release buttons 124 may be pushed and insert 128 withdrawn from receptacle connector 110.

Typically, when a cable 126 is used, cable 126 connects media payer 110 to a computer or other device or accessory (not shown). In this way, the computer can update media and other information on media player 100, retrieve information, provide control, charge a battery on media player 100, or provide or perform other functions. Media player 100 may also connect to an accessory through a docking station (e.g. having a male plug connector), and may be partially supported in the docking station with an appropriately sized insert that allows the docking station to accommodate different sized media players Such a connection allows the accessory to pass and receive information to media player 100, charge a battery on media player 100, and perform or provide other functions.

Figure 2A:
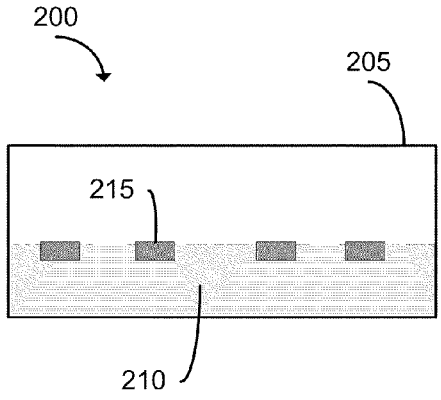
FIGS. 2A-2C are simplified front and cross-sectional side views of a connector arrangement including a male plug connector and a receptacle connector (neither of which are drawn to scale) that may be improved by the incorporation of embodiments of the present invention.
Figure 2B:
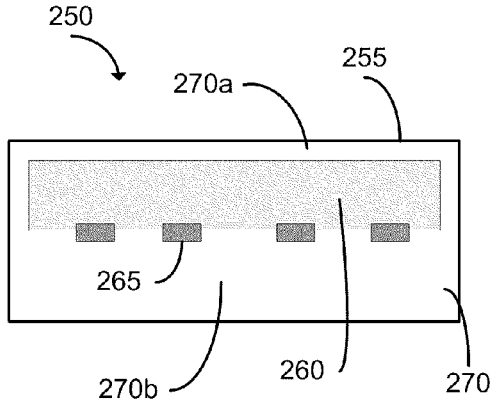
Figure 2C:
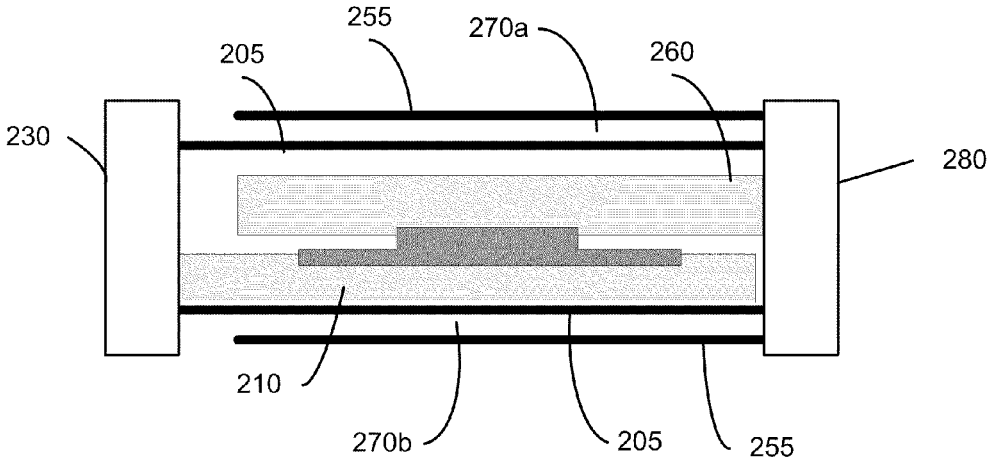

FIGS. 2A-2C are simplified front and cross-sectional side views of a connector arrangement including a male plug connector 200 and a receptacle connector 250 (neither of which are drawn to scale) that may be improved by the incorporation of embodiments of the present invention. These connectors are typically used to convey data and power to/from an electronic device, such as media player 100.

FIG. 2A shows a front view of a male plug connector 200 having a shell 205, an insulator 210, and contact pins 215. The male plug connector 200 is designed to have its shell 205 fit inside a corresponding receptacle connector. An example of such a connector is a universal serial bus (USB) connector.

FIG. 2B shows a front view of a receptacle connector 250 having a shell 255, an insulator tongue 260, and contact pins 265. Insulator 260 is a tongue that projects into a central region of a cavity 270, which surrounds the tongue. An upper section 270*a* of the cavity lies between insulator 260 and a top of shell 255, and a lower section 270*b* of the cavity lies between insulator 260 and a bottom of shell 255, thereby defining tongue 260. Shell 255 is larger than shell 205 so that male plug connector 200 can fit inside female receptacle connector 250.

FIG. 2C shows a cross-sectional side view of a connector arrangement created when male plug connector 200 is inserted into female receptacle connector 250. Shell 205 and insulator 210 are connected to a base 230, and shell 255 and insulator tongue 260 are connected to a base 280. Bases 230 and 280 may be grabbed by a user's hand during insertion.

As shown, shell 205 fits inside shell 255. Specifically, shell 205 fits between a top of tongue 260 and shell 255 in cavity region 270*a*. Shell 205 also fits between a bottom of tongue 260 and shell 255 in cavity region 270*b*. Although, a space is shown between shells 205 and 250, typically the shells would touch.

Such connectors often carry only one type of data signal, e.g. USB signals. Thus, if one wanted to provide multiple types of data signals to a media player using such connectors, multiple connectors would be required. Alternatively, embodiments of the present invention have a connector that can provide multiple interfaces. However, providing multiple high-speed interfaces with tight tolerances on a single connector can be difficult. Accordingly, embodiments of the present invention can provide receptacle connectors and corresponding male plug connectors that provide high-speed interfaces while maintaining the standards required by the interfaces.

Additionally, as the size of media player 100 decreases, the size of receptacle connector 110 becomes increasingly important. This is true for the size of the opening, that is, the receptacle connector's height and width, as well as its depth. A smaller opening allows media player 100 to be made thinner and narrower, while a shallower depth means that receptacle connector 110 consumes less of the usable area inside media player 100. Accordingly, embodiments of the present invention can provide receptacle connectors and corresponding inserts of male plug connectors having a smaller size in at least one of these directions.

Figure 3A:
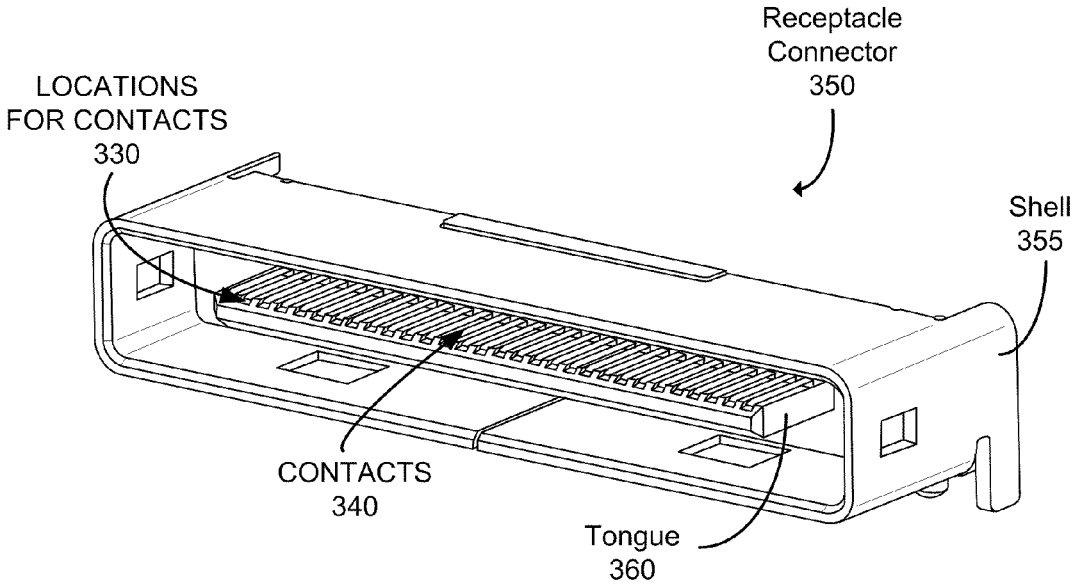
FIG. 3A illustrates a perspective view of a receptacle connector that can carry multiple high-speed data signals according to embodiments of the present invention.

FIG. 3A illustrates a perspective view of a receptacle connector 350 that can carry multiple high-speed data signals according to embodiments of the present invention. This figure, as with the other included figures, is shown for illustrative purposes only and does not limit either the possible embodiments of the present invention or the claims.

Receptacle connector 350 includes a shell 355 that surrounds a tongue 360. Tongue 360 can be a type of insulator core, where a cavity (space) surrounds the insulator core between the insulator core and the shell, thereby forming a tongue. Tongue 360 has a plurality of contact locations 330, where contacts 340 may be located. In some embodiments, each contact location 330 has a contact at that location. In other embodiments, some contact locations may be empty, i.e. no contact may be at a particular location.

A receptacle connector may also be referred to as a female connector. A male plug connector may also be referred to as a male connector or a plug connector. A connector insert of a male plug connector may be inserted into the receptacle connector to form connections in locations where contacts are located. In various embodiments, these connections may be electrical, optical, or other types of connections.

It may undesirable to carry a device having a connector insert. For example, because of its protruding nature, the connector insert may get bent or snagged. Accordingly, in systems where a device is a portable electronic device such as a portable media player, the receptacle connector can be located on the portable electronic device, while the connector insert can be located on a second device, such as a docking station or a cable adapter. A docking station may also include a receptacle connector. For example, a docking station may have a connector insert for connecting to a portable electronic device, such as a portable media player, and a receptacle connector for connecting to a cable or other device.

Contacts 340 can carry a variety of signals, e.g., ground, power, and multiple types of data signals. These data signals may be high-speed data signals, and each interface for a particular type of data signal may use multiple contacts. Examples of high-speed data interfaces include USB 3.0 and DisplayPort, each of which have a standard (requirements) for the signal behavior.

Figure 3B:
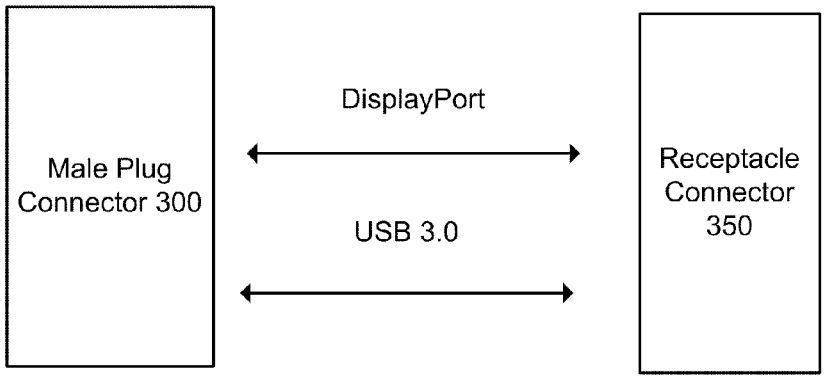
FIG. 3B is a block diagram illustrating the transmission of DisplayPort and USB 3.0 signals between receptacle connector and a male plug connector.

FIG. 3B is a block diagram illustrating the transmission of DisplayPort and USB 3.0 signals between receptacle connector 350 and a male plug connector 300. However, these and other new standards are often tough to satisfy. Problems with cross-talk and signal integrity often arise. These problems can arise when a standard is implemented using a connector specialized for that particular standard, and are further complicated when signal lines from various standards are combined into one connector, such as in connectors 300 and 350.

In some embodiments, connectors 300 and 350 can provide support for USB 3.0 (USB3) and legacy USB 2.0 (USB2). In one embodiment, the connectors include two USB2 contacts, four USB3 contacts, and a USB power and a ground contact. The USB3 standard is specified to transfer data at a "Super Speed" of 4.8 Gbps. An impedance of 90 ohms plus and minus ten percent needs to be maintained at this frequency to meet the USB3 specification.

In other embodiments, connectors 300 and 350 can provide support for multiple lanes of DisplayPort communication. In one example, the DisplayPort interface can provide a communication channel for a DisplayPort sink device and a DisplayPort source device over a main link, auxiliary lane link, and hot plug detect. In one embodiment, the DisplayPort source device can have receptacle connector 350 into which a male plug connector 300 may be inserted to provide signals to the DisplayPort sink device either directly or through a cable. Typically, a DisplayPort sink device can be a monitor. The DisplayPort source device can be a media player or other electronic device that includes a graphics video source, such as a laptop or desktop computer.

The main link may include one, two, or four lanes of data provided by the DisplayPort source device to the DisplayPort sink device. Depending on whether one, two, or four lanes are supported, this interface may require different numbers of contacts and may support different monitor resolutions. For example, a single lane can support resolutions of 1440×900, and require five contacts. If two lanes are selected, the number of contacts increases to seven, and the supported resolution can increase to 1680×1050. If four lanes are selected, eleven contacts are required, while a resolution of 2560×1600 can be supported.

The DisplayPort standard is specified to transfer data at a rate of 1.3 MP when one lane is selected, 1.8 MP when two lanes are selected, and 4.1 MP when four lanes are selected. Also, an impedance of 100 ohms plus or minus ten percent needs to be maintained at these data rates to meet the DisplayPort specification. Thus, the USB3 specification and the DisplayPort specification both require a specific impedance, plus or minus a certain percentage. A designation of which signals can be used with which contacts while providing these specifications is described below.

Figure 4:
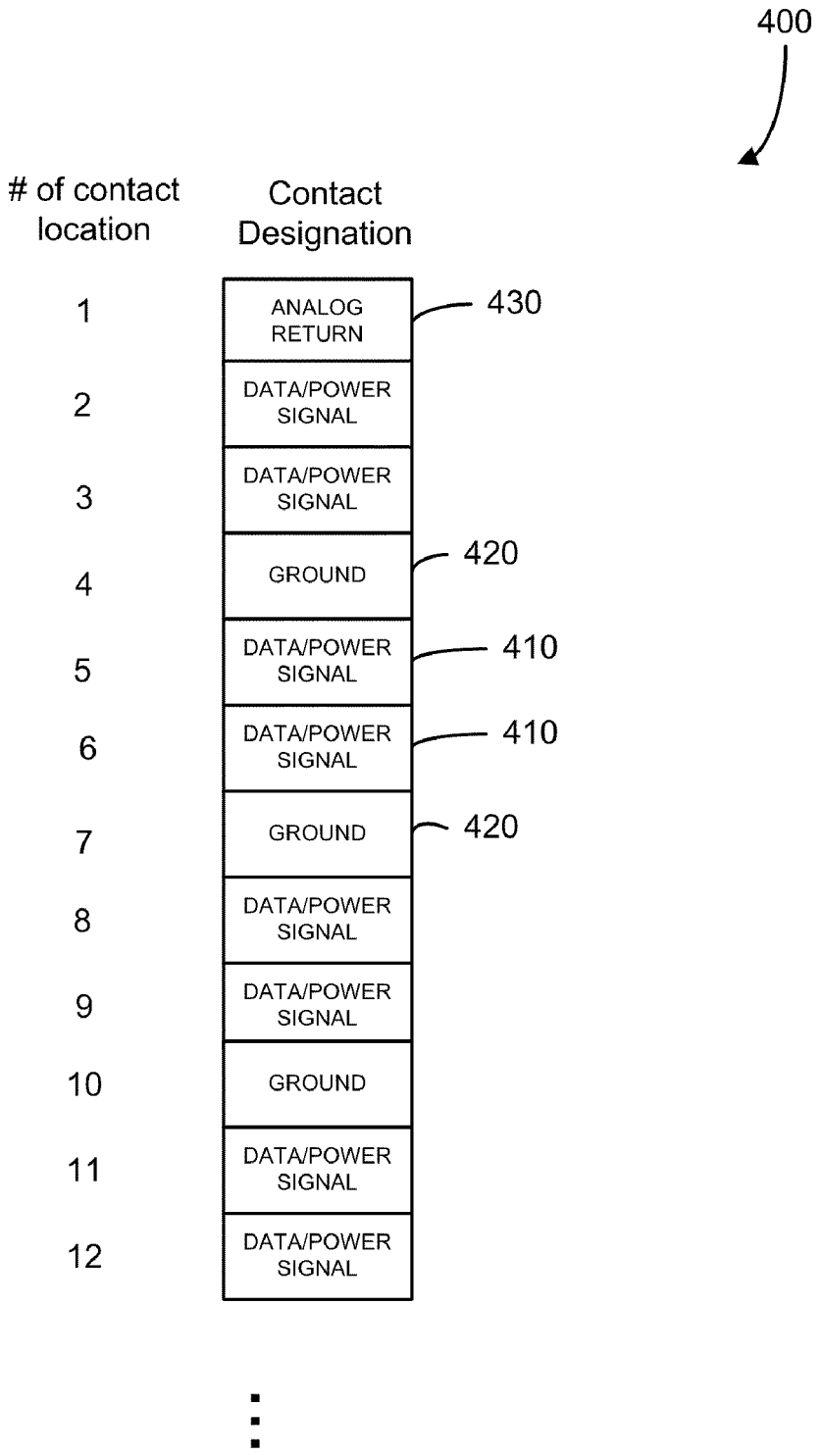
FIG. 4 shows a contact designation chart illustrating types of signals designated to be carried by contacts at various contact locations according to embodiments of the present invention.

FIG. 4 shows a contact (pin) designation chart 400 illustrating types of signals designated to be carried by contacts of various contact locations according to embodiments of the present invention. The contact locations may correspond to the contact locations 330, which can be in a single row. The contact location 1 may correspond to a contact location at either lateral end of connector. The contact locations then increase sequentially in number along the row.

In the example shown, the sequential contact locations are labeled as starting from 1 to 12. In other embodiments, the number of contacts may be greater than or less than 12, e.g., 11, 18, and 30. Additionally, the configuration for the designations shown may occur at different contact locations, but with the same order. For example, the contact location numbers shown could be from 7-18, instead of from 1-12.

As depicted, the contact designations for data/power signals 410 are located in pairs with ground designations 420 separating the pairs of signals 410. Thus, a ground designation 420 may occur at every third location number. In one embodiment, an analog return 430 may be located at one end of a data signal pair (e.g. location 1) or separating different signal pairs (e.g. at location 7).

In one aspect, an analog return is a return associated with an analog voltage signal. For example, the analog voltage signal may be a power signal, where the analog return can act as a negative terminal of a battery. In various embodiments, there may be multiple powers provided on the connector, such as powers for specific data interface (e.g. USB, DisplayPort). As another example, the analog return also may be associated with an analog audio or video signal.

The signals 410 may be a digital data signal, an analog data signal, or a power signal. In one embodiment, the data signals can be sent across a cable as a twisted signal pairs. For example, certain DisplayPort signals may be sent as a differential pair whose signals may be carried by contacts at locations that are next to each other.

When contacts are placed into the contact locations and signals are transmitted, the positioning of the ground between pairs of data signals can help to provide high-speed data communication. For example, this grounding configuration can control impedance and reduce crosstalk by reducing the electromagnetic coupling between the signal lines. Simulations of a performance of a contact designation using such a grounding configuration is now described.

Figure 5A:
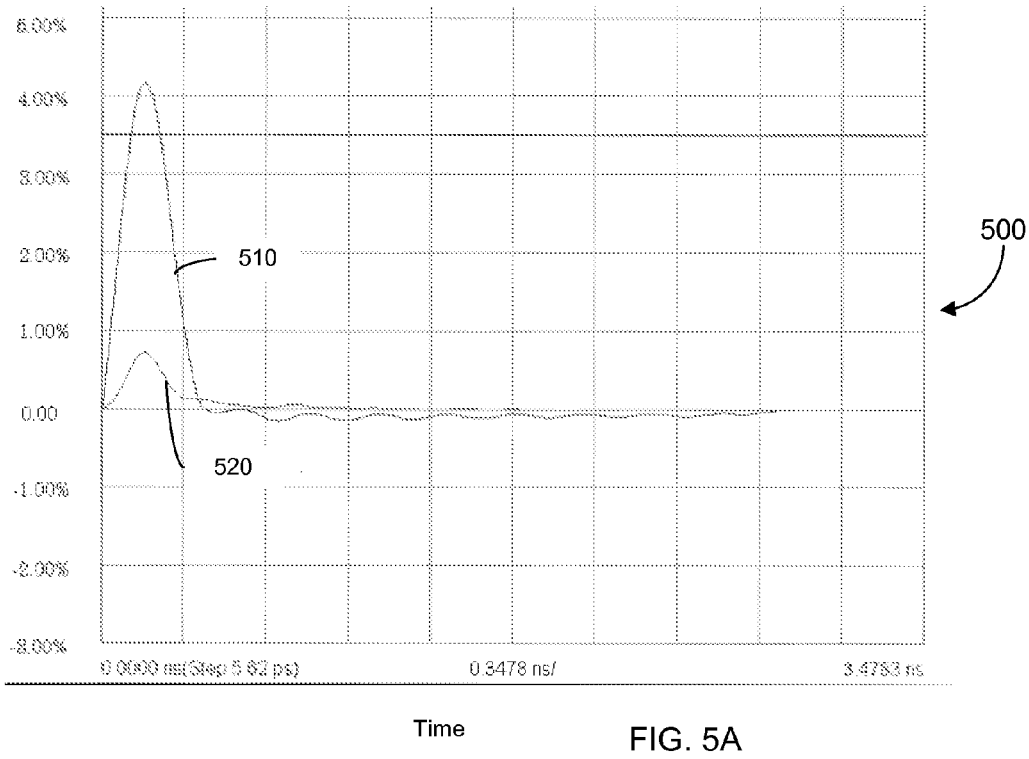
FIGS. 5A-5C show plots illustrating simulated performance characteristics of a connector having a contact designation according to embodiments of the present invention.
Figure 5B:
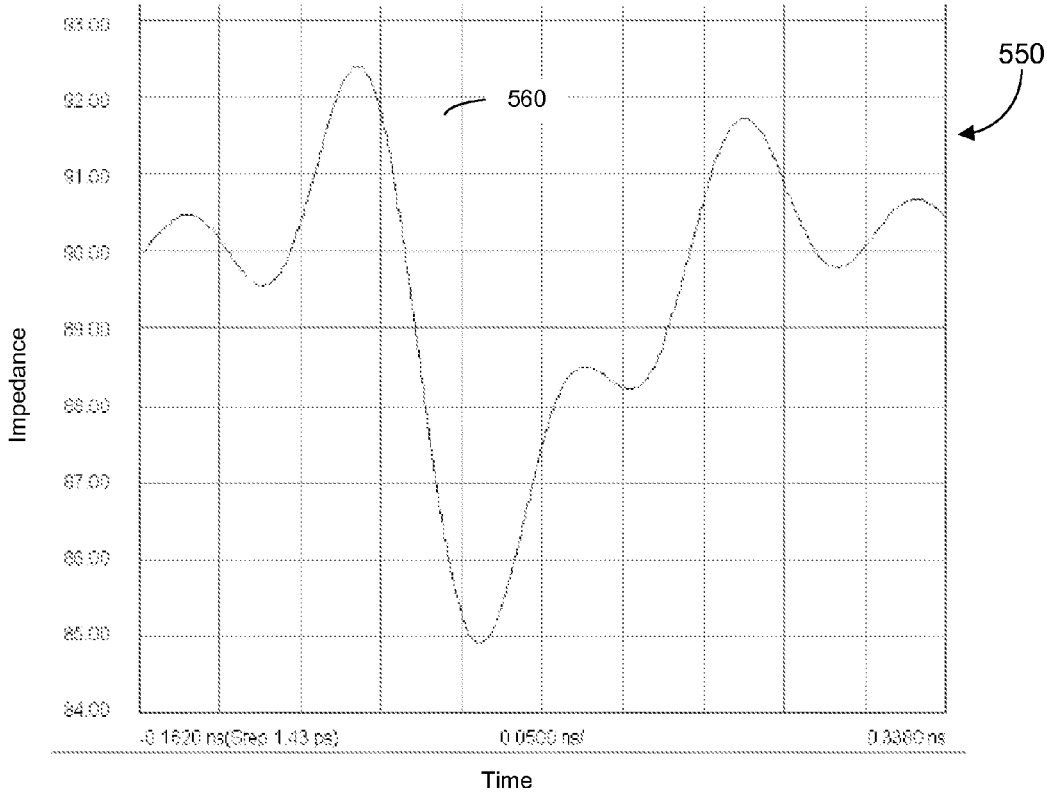
Figure 5C:
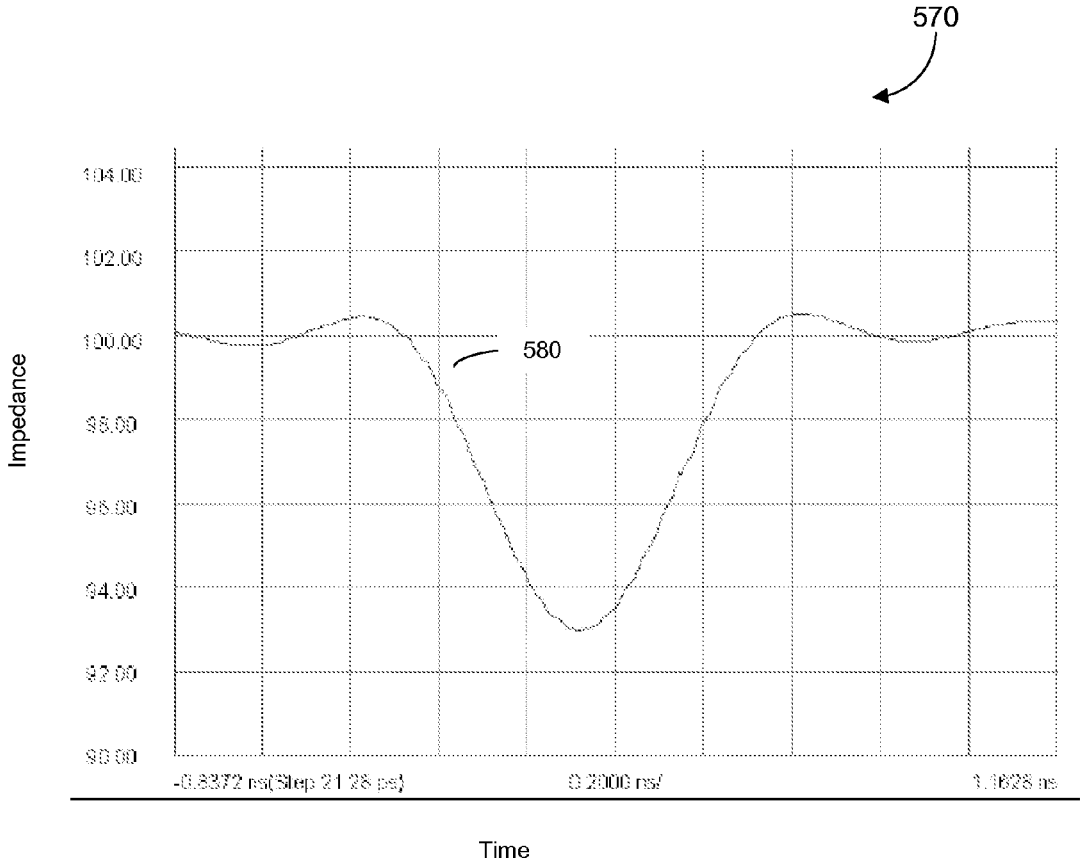

FIGS. 5A-5C show plots illustrating simulated performance characteristics of a connector having a contact designation according to embodiments of the present invention. An S-Parameter model was created using a contact configuration of 10 contacts with four ground contacts, where two data contacts are between each ground. The data signals in order are a DisplayPort lane pair, a DisplayPort auxiliary pair, and a USB 3.0 pair.

The S-Parameter model was evaluated for impedance and Far End Crosstalk (FEXT) up to 10 GHz. The simulation results showed that this contact configuration meets USB impedance requirement (90Ω±10%), the DisplayPort impedance requirement (100Ω±10%), and had a crosstalk of less than 3%. The insulator was modeled to be 15% glass fiber (GF) Liquid-crystal polymer (LCP), with a dielectric constant of 2.5. The contacts were modeled as C7025 (Cu—Ni—Si) having electrical conductivity of 40% IACS (International Annealed Copper Standard), a thermal conductivity of 98 Btu/sq ft/ft/hr/° F.; Electrical Resistivity, and 26Ω(cir mil/ft).

FIG. 5A shows a plot 500 illustrating a cross talk 510 for a contact configuration of 6 consecutive data signals and a cross talk 520 of 3 pairs of data signals with ground between the pairs as shown in FIG. 4. The Y-axis shows the percentage level of cross talk. The X-axis is time. As shown, cross talk 520 satisfies the USB 3.0 requirement of being less than 3%, whereas the cross talk 510 is greater than 3%. A signal rise time of 80 pico seconds from 10% to 90% of the signal amplitude was used.

FIG. 5B shows a plot 550 illustrating a USB 3.0 differential pair impedance 560 for a contact configuration having pairs of data contacts separated by ground contacts. The Y-axis shows the impedance of the USB contacts. The X-axis is time. As shown, the impedance 560 satisfies the USB 3.0 requirement of being 90Ω±10%. To maintain signal integrity, the USB signal pairs may also be separated from the USB power pins. A signal rise time of 70 pico seconds from 10% to 90% of the signal amplitude was used.

FIG. 5C shows a plot 570 illustrating a DisplayPort differential impedance 580 for a contact configuration having pairs of data contacts separated by ground contacts. The Y-axis shows the impedance of the DisplayPort contacts. The X-axis is time. As shown, the impedance 580 satisfies the DisplayPort requirement of being 100Ω±10%. A signal rise time of 130 pico seconds from 20% to 80% of the signal amplitude was used.

Various pinouts (e.g. which signals are designated for which signal contacts) may be utilized by connectors according to embodiments of the present invention. These pinouts may depend in part on the standards that are supported by the connectors and receptacles. Also, the pinouts may depend on which options of the various standards are supported. For example, the number of pins used by a DisplayPort interface may vary depending on the data transfer rate that is supported. In some embodiments, these pinouts conform to the configuration of pin designation chart 400, e.g., having pairs of signal contacts separated by a ground contact. Two examples of signals that may be employed by receptacles and inserts according to embodiments of the present invention are shown in the following figure; other pinouts may be employed consistent with embodiments of the present invention.

Figure 6A:
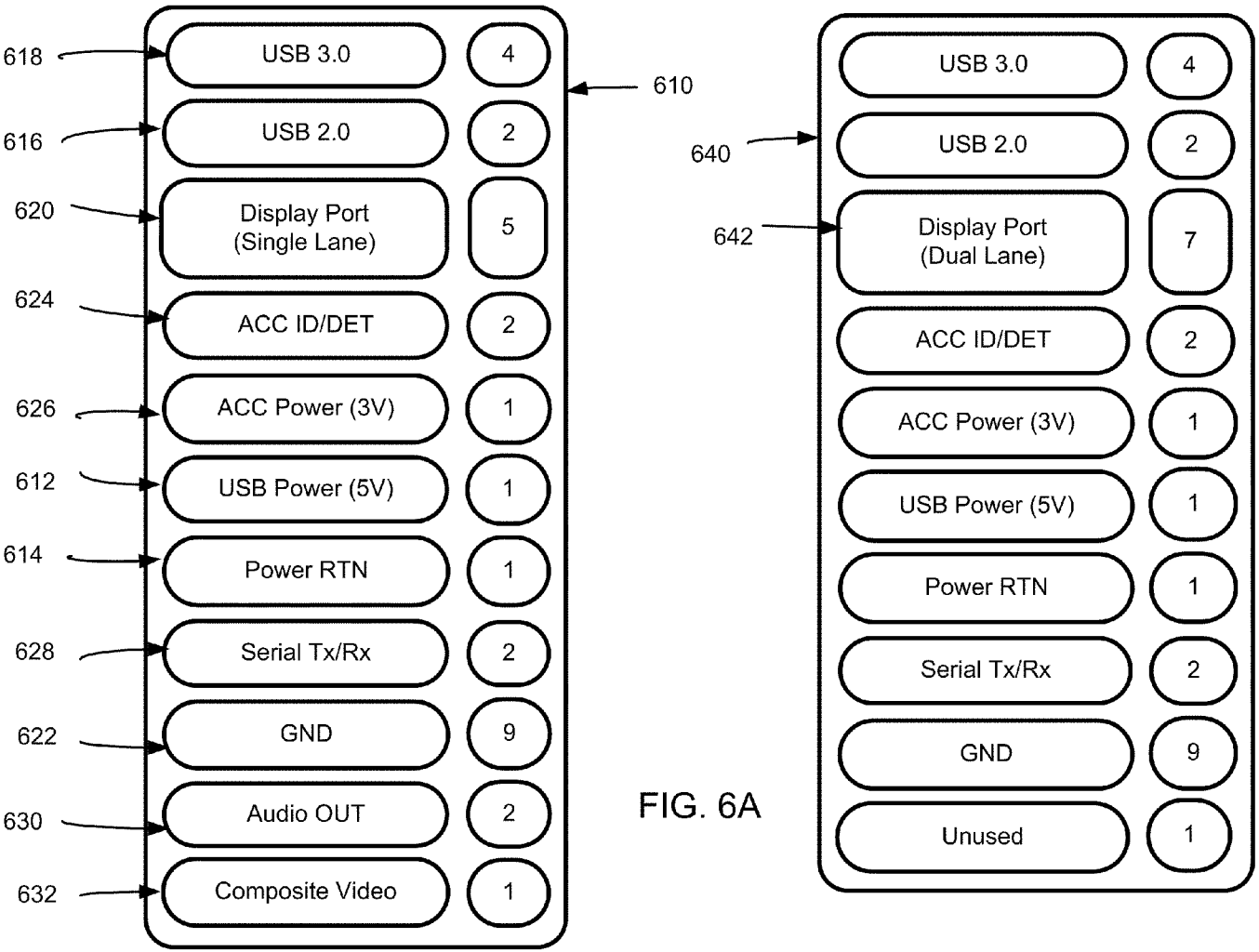
FIG. 6A shows an example of the types and specific number of signals that may be carried on connectors according to embodiments of the present invention.

FIG. 6 shows an example of the types and specific number of signals that may be carried on connectors according to embodiments of the present invention. Pinouts 610 and 640 show types of signals along with the number of contacts used for each type of signal. Pinout 610 uses 30 contacts, and pinout 640 uses 29 contacts.

Pinout 610 includes contacts for the USB3 standard. The contacts for USB3 include contacts for legacy support of USB2, including USB power 612 and ground 614, as well as data contacts 616. Two pairs of data contacts 618 for USB3 support are also included. Contacts 620 for a single lane DisplayPort interface are also included.

Ground contacts may be used to provide isolation between pairs signals, e.g., between pairs of DisplayPort contacts and pairs of USB contacts. Accordingly, nine ground contacts 622 and a power return 614 (which may also be considered a ground contact) can be included to provide isolation. In one embodiment with sequentially numbered contact locations for the contacts being in a single row, a ground contact can be at a contact location 1, and the other 9 ground contacts can be at every third contact location (i.e. 4, 7, . . . ).

Other contacts including accessory identification and detect 624, accessory power 626, serial interface pins 628, analog audio output 630, and composite analog video output 632 can also be included.

Pinout 640 supports a higher speed DisplayPort interface than pinout 610. Specifically, a second lane is added to the DisplayPort 642, while the legacy audio and composite video outputs are dropped. If 30 contacts exist in the connectors, the unused contact for pinout 640 may be placed at any of the contact locations.

FIGS. 6B-6F show examples of contact designations (pinouts) for receptacle connectors and corresponding male plug connectors according to embodiments of the present invention. In each pinout, the "Pin" column provides a sequentially numbered list of contact locations from one end of a connector to another end. In one embodiment, these contact locations can correspond to the contact locations 330 of receptacle connector 300 or to other contact locations described herein.

Each one of these contacts locations can be designated for a contact that has a particular function(s), thus the contact location is designated for that particular function(s). The "Function" column provides a list of one or more functions for which the contact location is designated. Note that the contact locations for the shell are designated at the end of the "Pin" column. These contact locations can refer to the contact of shells of the male plug connector with the receptacle connector. For example, a shell of the male plug connector can contact a top and bottom of a shell of the receptacle connector. Thus, in one embodiment, these contact locations may not occur in a single row of the other contact locations.

FIG. 6B shows a pinout 650 that supports USB3 and a single channel of DisplayPort according to embodiments of the present invention. Contact locations for ground are located at every third contact location starting at location 1. In various embodiments, the ground function can be provided by digital ground, a return for audio signals (#28), a return for power (#22), and a remote sense (#25), which can return a low side of load voltage. A ground may be controlled from within the device (e.g. a media player) to which the receptacle connector is part of or controlled by the device that the male plug controller is part of. In one embodiment, contact location 19 for ground is controlled by a media player in which a receptacle connector is part of and may be used by an accessory to determine when a media player is present.

Contact locations 2 and 3 are designated for a differential pair of USB3 signals for transmitting, where for the corresponding connector it would be for receiving. Contact locations 5 and 6 are designated for a differential pair of USB3 signals for receiving. Contact locations 8 and 9 are for USB2 signals. In an embodiment where there are contacts at each of these locations, having each differential pair separated by a ground helps to provide lower cross talk and greater impedance control.

Contact locations 11 and 12 can be for one lane of DisplayPort signals, and contact locations 14 and 15 can be for DisplayPort auxiliary signals. In one aspect, locating the USB and DisplayPort signal at one end of the sequential list provides separation from analog signals at the other end.

Contact location 17 provides the hot plug detection for DisplayPort, which may be used as an interrupt request, e.g., for a source device to detect when a sink device (display) is attached. The USB power can be located at contact location 18. In one embodiment, the signal of the hot plug detect is not presented often or only during an initial connection or reset, and thus may not interfere much with the other DisplayPort signals.

An accessory identification signal (which can be used to notify a media player of specific accessory device) and an accessory power signal (which can be provided from a media player to an accessory) can be located at contact locations 20 and 21, respectively.

Both of these signals can be a constant voltage, and thus provide lower interference with each other. In one embodiment, as the hot plug detect, USB voltage, accessory identification, and accessory voltage can generally have a substantially constant voltage, these designations can provide a buffer between the digital signals and the analog signals, which do change frequently, such as serial, analog audio, and analog video.

Contact locations 23 and 24 can be used for serial protocol. Contact location 26 can be used to detect when an accessory is connected. For example, an accessory can keep this signal low (e.g. at or near ground); and when it is connected, the media player can detect the low voltage. As the accessory detect can be connected to a ground, it can provide low interference with the composite video at location 27. Audio output can then be provided at locations 29 and 30.

FIG. 6C shows a pinout 660 that supports USB3 and a dual channel of DisplayPort according to embodiments of the present invention. In pinout 660, an accessory detect and the DisplayPort hot plug detect are placed next to each other at locations 20 and 21, respectively. In one embodiment, these detect signals may not change voltage often, and thus along with the accessory identification signal and accessory power signal, can provide shielding between the digital USB and DisplayPort signals and the analog serial signals at locations 26 and 27. USB power can be placed at location 29 next to power return at location 28. In this example, contact location 30 does not have a designated function and in some embodiments may not have a contact at this location. Such a pinout may be used for a media player that is focused on video. Audio for the video can be carried together with video in either or both of the DisplayPort lanes. Again, all of the digital signals can be placed toward one end of the connector, with the analog signals being placed toward the other end.

FIG. 6D shows a pinout 670 that supports USB3 and a quad channel of DisplayPort according to embodiments of the present invention. Contacts 8 and 9 can be dual use between USB2 signals and the DisplayPort auxiliary signals. In one aspect, the signals can be controlled such that both types of signals may not be transmitted at the same time.

Internal circuitry of the devices can be made to switch between the two types of signals. For example, the hot plug detect signal may be used to communicate that the DisplayPort auxiliary signals are to be used. The accessory detect (#26) and DisplayPort hot plug detect (#27) can also be placed at locations 23 and 24, similar to pinout 660. Contact locations 29 and 30 can have USB power and an accessory identification signal, which may provide a lower level of interference with each other since both can generally be a substantially constant voltage.

FIG. 6E shows a pinout 680 that supports USB2, audio, and DisplayPort according to embodiments of the present invention. Pinout 680 can support up to 18 contacts for contact locations in a single row. Location 6 can be designated for a USB On-The-Go (OTG) signal. In another embodiment, the hot plug signal is designated for location 16, with the DisplayPort auxiliary signals be paled at locations 17 and 18.

FIG. 6F shows a pinout 690 that supports USB2, audio, and video according to embodiments of the present invention. Pinout 680 can support up to 18 contacts for contact locations in a single row. An audio/video return can be designated for contact location 10 to suppress crosstalk and to provide optimal analog audio (#8 and 9) and analog video (#11).

FIG. 6G illustrates a mating sequence and wiping distance of pinouts according to embodiments of the present invention. The mating sequence provides for an initial mating between the shells. The ground contacts are mated second. The signal contacts are mated last. In one embodiment, the ground contacts can be staggered and thus have a larger amount of wipe, than other contacts These features are discussed in greater detail with respect to FIGS. 11 and 14.

Some embodiments also provide connectors with a reduced dimension of width, e.g., by reducing a spacing between contacts. However, providing reduced size receptacle connectors and male plug connectors that can support communications using one or more of the newer high-speed communication interfaces (such as USB3 and DisplayPort) can be difficult. To support these interfaces, cross-talk should be minimized and signal integrity maintained. Also, as described above, these specifications typically have strict impedance matching requirements that need to be met to reduce signal ringing and reflections. Accordingly, some embodiments of the present invention can employ techniques such as providing proper contact sizes, shapes, and spacing, as well as other techniques.

Figure 7:
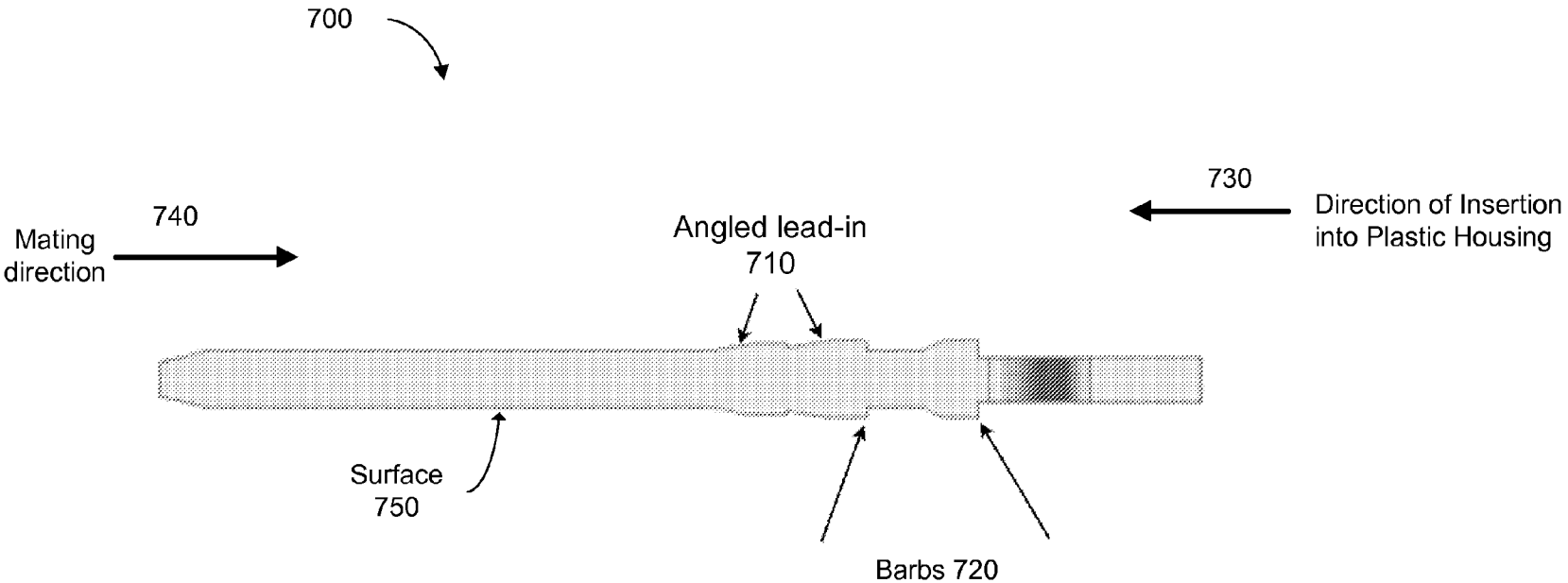
FIG. 7 shows a top view of a conventional contact used in a receptacle connector.

FIG. 7 shows a top view of a conventional contact 700 used in a receptacle connector. Contact 700 is a press fit style contact that is inserted into a plastic housing and requires barbs for contact retention. Other contacts would be located to the sides of contact 700, i.e. above or below contact 700 as shown on the paper.

Contact 700 is inserted into a plastic housing in a direction 730. For example, the plastic housing may have slots into which contact 700 is inserted, where the slots are smaller than contact 700. Angled lead-ins 710 allows contact 700 to be inserted easily into the plastic housing. Upon insertion, contact 700 digs into the plastic housing in order to form a fixed seat in which contact 700 will rest. For example, barb portions 720 of contact 700 are wider than the slot in the plastic housing so that plastic material is still displaced, thereby providing the retention. Note that barbs 720 and angled lead-in 710 are in the same plane as the other contacts Once contact 700 is seated into the housing and the receptacle connector is finished, the receptacle connector may be mated with a male plug connector. During the process of mating, contact 700 encounters a corresponding contact from the male plug connector along direction 740. When the mating occurs, a force is imparted on contact 700 in direction 740. To prevent contact 700 from becoming unseated or otherwise dislodged during mating, the series of barbs 720 of increasing width dig into the plastic housing, thus providing a retention force.

However, contacts such as contact 700 may not be able to support high-speed data communications, especially if a reduced spacing between contacts is used. For example, the shape of contact 700 can cause problems in signal integrity. Since barbs 720 stick out from a surface 750, the minimum distance between neighboring contacts is reduced at barbs 720. Thus, the wide barb sections of contact 700 reduce the contact spacing, which increases capacitive coupling between adjacent contacts and affects connector impedance.

Also, barbs 720 contain abrupt changes from surface 750. The abruptness of this changing spacing between adjacent contacts also alters the capacitive and inductive coupling along the electrical path. In high-speed signals, this will affect circuit impedance resulting in poor signal integrity.

Figure 8A:
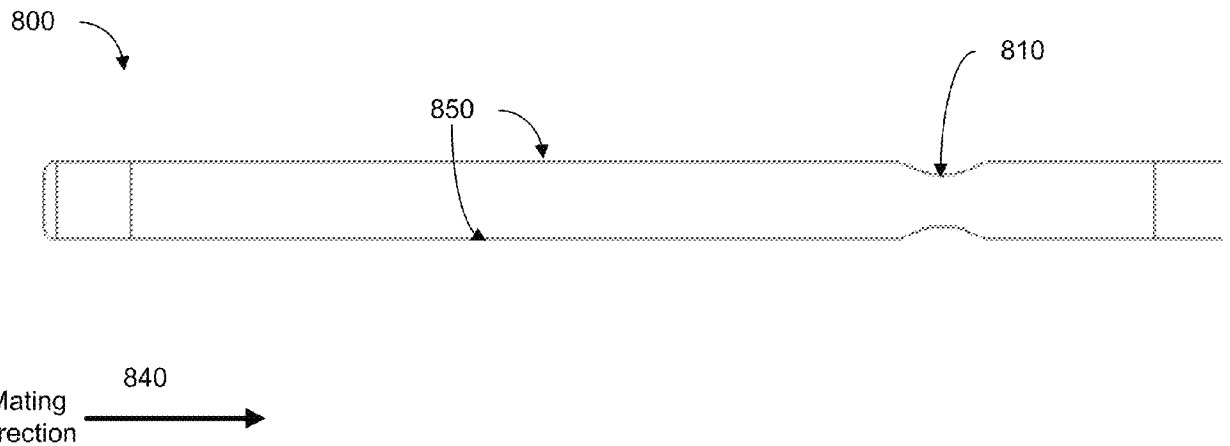
FIG. 8A shows a top view of a contact that can be used in a reduced-width connector while maintaining signal quality at high frequencies according to embodiments of the present invention.

FIG. 8A shows a top view of a contact 800 that can be used in a reduced-width connector while maintaining signal quality at high frequencies according to embodiments of the present invention. Embodiments below generally describe such contacts with respect to a receptacle connector. However, contact 800 may be used in a receptacle connector or a male plug connector.

In one embodiment, contact 800 has a housing molded around it (e.g. via insert molding), thereby allowing a certain shape. During the molding process, insert molded contacts can be encapsulated (partially or completely) in the insulator core. Such a molding process can eliminate the need for barbs to facilitate contact insertion and retention.

As shown, contact 800 can have side surfaces 850, which do not have any protrusions, as does contact 700. Side surfaces 850 face the other contacts in the insulator core. In one embodiment, side surfaces 850 are substantially parallel to each other except for one or more recesses 810.

During a molding process, plastic (or other suitable material) can flow into recesses 810. Since plastic is within recess 810, contact 800 can be held into place during mating. Thus, a retention force can be provided via recesses 810, and an axial movement of contact 800 along direction 840 as a result of mating can be reduced.

Since the holding mechanism is a recess and not a protrusion, the minimum distance (and maximum distance) is defined by the side surface 850 and not by a protrusion (such as barbs 720). Therefore, the spacing between the surfaces can be reduced, which can provide a reduced width of the connector.

Additionally, recesses 810 of contact 800 provide more subtle retention features, allowing for more uniform spacing between adjacent contacts. In one embodiment, the surface of the recess can be curved, and not have the sharp edges like contact 700. Such a curved surface for recesses 810 can result in stable capacitive and inductive coupling along the electrical path, as well as a consistent and matched circuit impedance and good signal integrity. In another embodiment, a slope at any point on the surface of a recess (or any point on the side surfaces 850) is at an angle of less than 45 degrees with respect to the plane of the side surface that the recess is on. Having such gradual slopes can also result in stable capacitive and inductive coupling since the change in the spacing between side surfaces of neighboring contacts is small. Such gradual slopes can be on a recess that is curved or one that is a combination of flat surfaces, each which has a slope of less than 45 degrees.

The reduced width may be described as having reduced pitch (average spacing between the contacts). In one embodiment, the contacts have a pitch of less than 0.4 mm. In some embodiments, the spacing may vary between contacts designated for different signals. Thus, different sets of contacts may have a different spacing between them. In one embodiment, a first set of contacts (e.g. at a first region of contact locations) have approximately the same size and spacing as a second set of contacts (e.g. at a second region of contact locations). In another embodiment, the first set of contacts have a different pitch as the second set of contacts.

Accordingly, embodiments of the present invention can provide receptacle connectors and male plug connectors having a reduced contact width and/or spacing that support high-speed data interfaces. In one embodiment, the contact width and spacings are configured to provide an impedance between 90 and 100 ohms such that the impedance requirements for both USB3 and DisplayPort standards are met. In another embodiment, the width and spacings for the USB3 contacts are different than the width and spacing used for the DisplayPort contacts, such that contact width and spacings for each specification are optimized.

Some embodiments can also provide contacts with reduced damage from mating. Typically, a contact on at least one of the receptacle connector or the male plug connector has an exposed front end, where mating occurs. This exposed front end has a potential for stubbing (i.e. the contact ends butt up to one another preventing proper engagement). If stubbing occurs, contacts can be damaged, or in extreme cases, unseated from the housing.

Figure 8B:
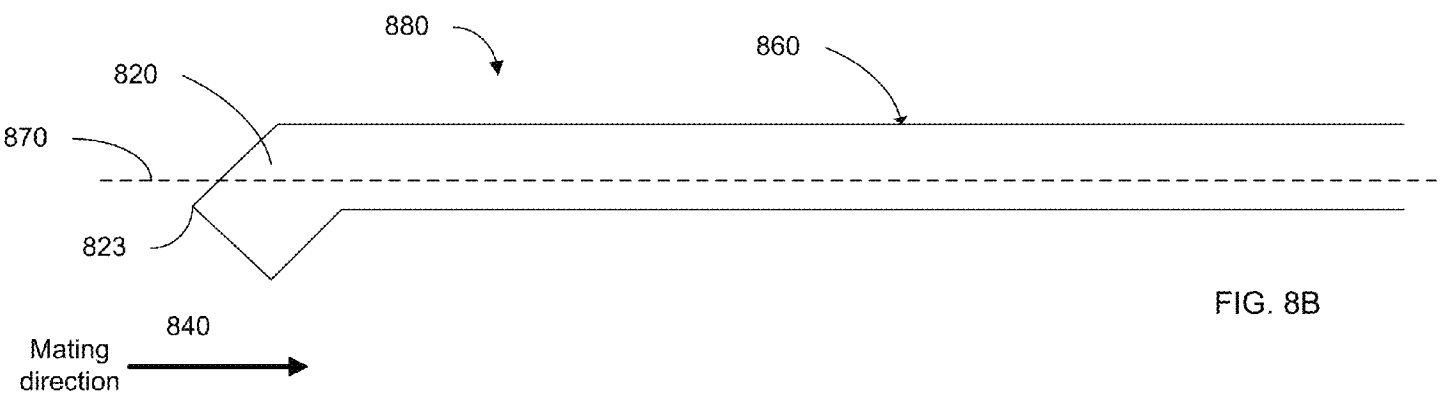
FIG. 8B shows a side view of contact that can provide reduced wear as a result from mating according to embodiments of the present invention.

FIG. 8B shows a side view of contact 880 (which may be contact 800) that can provide reduced wear as a result from mating according to embodiments of the present invention. A front end 820 of contact 800 has a shape that bends down from a top surface 860 of contact 880. Front end 820 of contact 880 can be embedded into an insulator core to prevent stubbing against mating contact. As an illustration of such embedding, a surface 870 of an insulator core is shown as being above the front edge 823 of front end 820. In this manner, the mating contact does not butt against the very front edge 823, and a smooth path is provided for the mating contact during the mating process.

In one embodiment, the insulator core may have a raised step (not shown) between the contacts so that metal debris does not cause a short. The insulator core thus may have slots in which the contacts are embedded and have walls between the contacts, where the walls are higher than surface 860 of contact 880. Thus, contact 880 may reside in a slot with part of the contact below the bottom surface of the slot. A method making a connector, e.g., having a contact 800 and/or contact 880, is now described.

Figure 9:
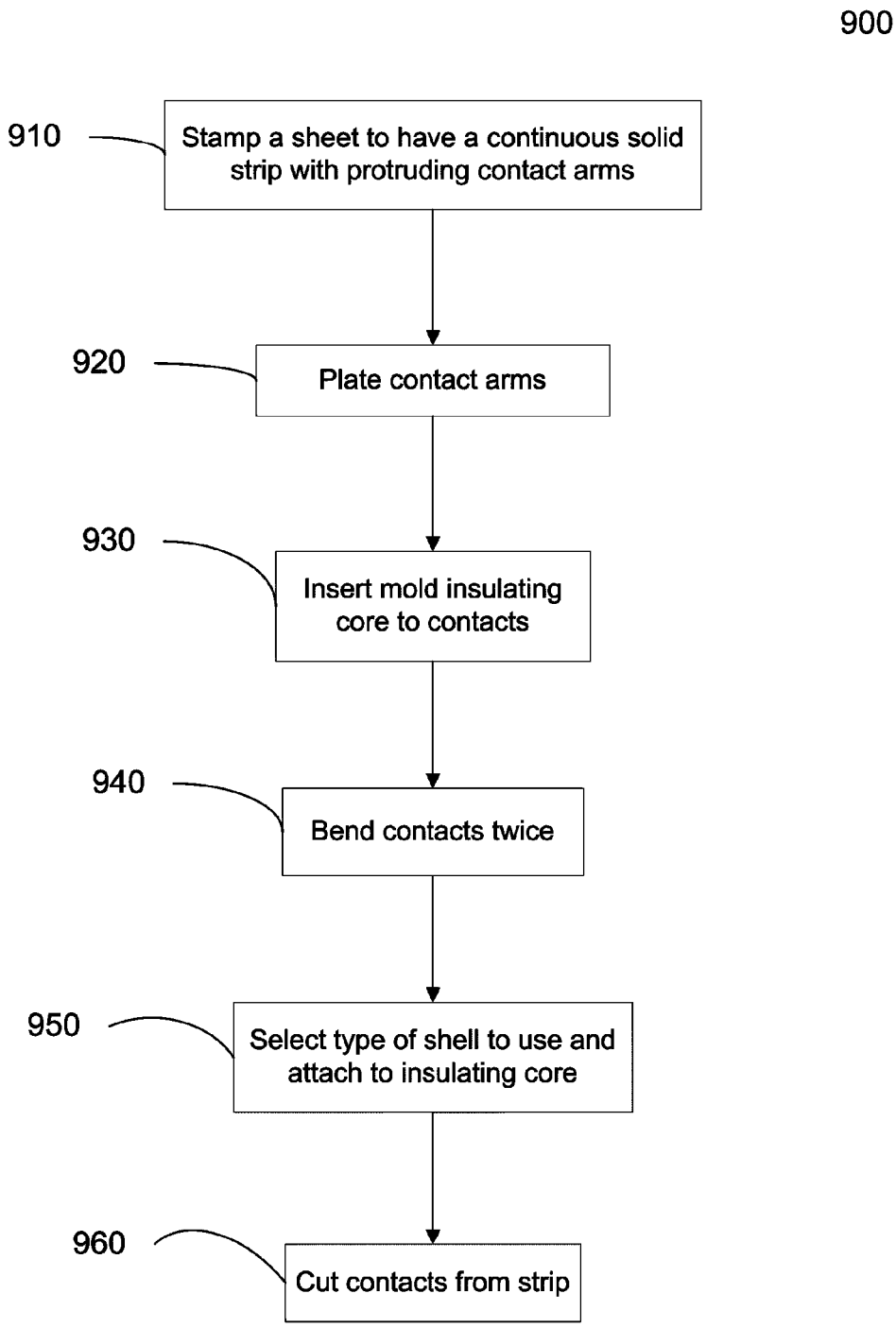
FIG. 9 is a flowchart illustrating a method 900 for making receptacle connector according to embodiments of the present invention.

FIG. 9 is a flowchart illustrating a method 900 for making receptacle connector according to embodiments of the present invention. In one aspect, method 900 may be used as a method of manufacturing a plurality of receptacle connectors for a variety of types of media players.

In step 910, a sheet of a conductive substance is stamped to have a continuous solid strip with contact arms (e.g. with the shape of contact 800 and/or 880) protruding like teeth from the strip. In one embodiment, the stamped sheet has contacts to make a plurality of connectors.

In step 920, the contact arms are plated. In one embodiment, a front section of the contacts are plated with gold, and a back section (near the strip) are plated with tin. In one embodiment, the contacts may be made of copper covered with nickel, where the nickel acts as a barrier layer between the copper and a layer of gold. The gold may be used to resist corrosion and provide a good electrical connection. The ends of the contacts may be plated with tin to enhance solderability. Such a contact may provide, for example, an electrical conductivity of approximately 40% IACS, a thermal conductivity of approximately 98 BTU/sq ft/ft/hr/degrees F., and an electrical resistivity of approximately 26 ohms (cir mil/ft).

In step 930, an insulator core is insert molded onto the contacts. For example, the contacts may be placed into a plastic injection mold during the molding process. The molten plastic may then flow around the contact completely or partially encapsulating the contact. In one embodiment, the strip is fed with the contact tips up during the molding process. The plastic may flow into a recess (such as recess 810) in the contact, preventing any axial movement during mating, as described above.

In one embodiment, the insulating material in the insulating core may be a liquid crystal polymer, such as a 15% glass-filled liquid crystal polymer, nylon, glass filled nylon, or other appropriate material. The dielectric constant of such as material may be, for example, 2.5. This insulating material may also be used in male plug connectors described herein. The materials used in either or both the receptacle connector common insulating core and shell may be made of plastic or other nonconductive materials to avoid interference with radio transmissions to or from an electronic device.

In step 940, the contacts are bent down (e.g. by 80 degrees) at a first point between the insulator core and the strip, and then bent parallel at a second point between the first point and the insulator core. In one embodiment, the contacts may be bent by moving the insulator core while holding the strip. In some embodiments, this core/contact assembly (or substantially identical insulating core/contact assemblies, e.g., with varying numbers of contacts) may be used in multiple types of electronic devices. For example, the core/contact assembly may be used in all of the devices of an entire line of media players.

In step 950, a shell is selected from a plurality of types of shells and is attached to the insulator core. Each shell can be configured to attach to the insulating core, and other insulating cores made from steps 910-940. Each type of shell can be configured to be used for a different electronic device. In one embodiment, the shell is a metal shield. In another embodiment, the shell is plastic, nylon, or other appropriate material. Thus, the insulator substrate and shell may be nonconductive. The plastic shell can have a metal ride plate for a latch of the make plug connector. The metal plate may be added in a separate step.

In one embodiment, attaching the selected shell to the respective insulating core includes placing the insulating core on an inside bottom surface of the selected shell. Thus, the shell may have a bottom configured to be adjacent to an insulating core. Such a connector may have a reduced height, which is described in more detail below.

The insulator core can have a stop at one surface (e.g. top or bottom) that rests against the shell. Clips on the metal plate can then attach into the core and prevent insert molded core from being pushed out of the back of the shell.

In step 960, the contacts are cut from the strip. Accordingly, embodiments of the present invention can utilize the common portion of the insulating core/contact assembly among receptacle connectors for different types of media players. An example is shown in the following figure.

Some embodiments can also provide connectors with a reduced dimension of height. A reduced height of a connector can provide a slimmer electronic device that uses the connector. The reduced height can be provided by placing an insulator core with contacts on a surface of a surrounding shell. Thus, the connector may no longer have a tongue.

Figure 10:
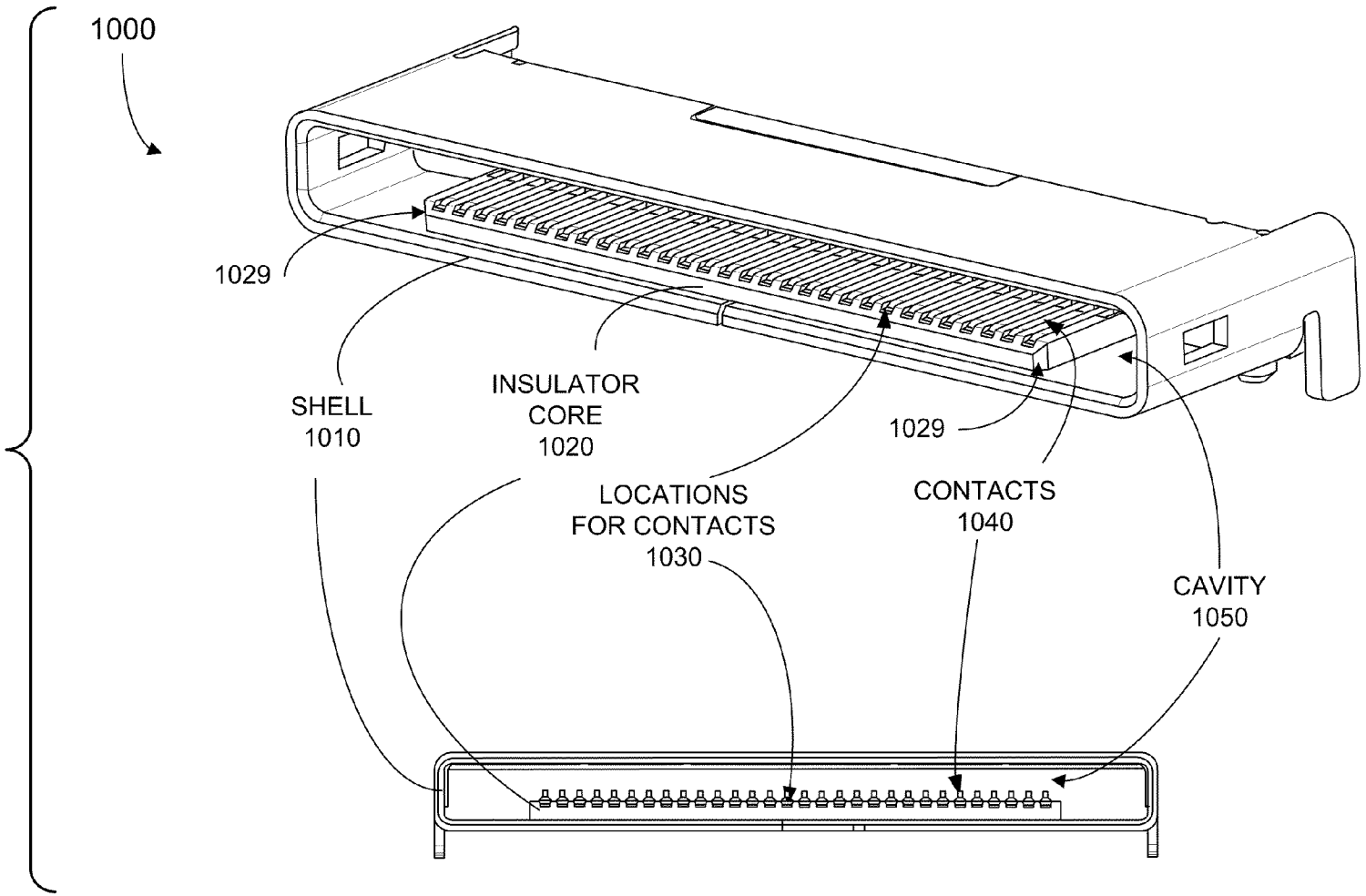
FIG. 10 illustrates perspective and front views of a receptacle connector 1000 that has a reduced height according to embodiments of the present invention.

FIG. 10 illustrates perspective and front views of a receptacle connector 1000 that has a reduced height according to embodiments of the present invention. Receptacle connector 1000 includes a shell 1010, an insulator core 1020, a plurality of contact locations 1030 spaced apart in a single row on insulator core 1020, and a plurality of contacts 1040 at contact location 1030.

In this example, the reduction in height is achieved by eliminating a space between insulator core 1020 and a bottom of shell 1010. In other words, the tab or tongue that is often included in connectors is not present here. Specifically, insulator core 1020 is adjacent to a bottom of the shell 1010. A cavity 1050 has a first region between insulator core 1020 and the sides of shell 1010 and has a second region between insulator core 1020 and the top of shell 1010. These regions can receive a corresponding male plug connector.

In various embodiments, insulator core 1020 may be affixed to the bottom of shell 1010 or may simply rest on the bottom of shell 1010. In one embodiment, another material (e.g. a separate insulator) may reside between the bottom of the shell and the insulator core 1020, which can effectively make this another material a part of shell 1010 or insulator core 1020. For example, the insulator core may include an insulating substrate in which contacts are attached, and this insulator core may be attached on top of another material to form the insulator core. By eliminating space between insulator core 1020 and the bottom of shell 1010, the height of receptacle connector 1000 is reduced.

In one embodiment, insulator core 1020 includes a chamfer 1029 at a first end of a front surface of insulator core 1020. In one aspect, chamfer 1029 is a sloped surface (e.g. at a 45 degree angle) that can guide the male plug connector into lateral alignment around insulator core 1020. Another chamfer can be located at the opposite end of the front surface of insulator core 1020. This alignment is discussed more below.

In some embodiments, the width of receptacle connector 1000 is also reduced. This can be achieved by reducing the spacing between contacts 1040. Thus, the contacts can be placed closer together, thereby reducing the width of receptacle connector 1000. In one embodiment, contact 800 of FIG. 8A can be used as contacts 1040, which can allow for support of high-speed data interfaces. The width of a contact can also be reduced. In various embodiments, the width, spacing, or both width and spacing of contacts 1040 are reduced.

In this example, a contact 1040 is shown at each contact location 1030. In various embodiments, one or more of these contacts may be absent. For example, receptacle connector 1000 may be located in a device having reduced functionality. In such a situation, some contacts may not be needed, and may be omitted consistent.

Also in this example, receptacle connector 1000 has an opening that is somewhat rectangular. In other embodiments, the opening can be rounded on the ends. In still other embodiments, the opening may have other shapes, e.g., to receive different shapes of male plug connectors. A male plug connector with a reduced height is now described.

Figure 11:
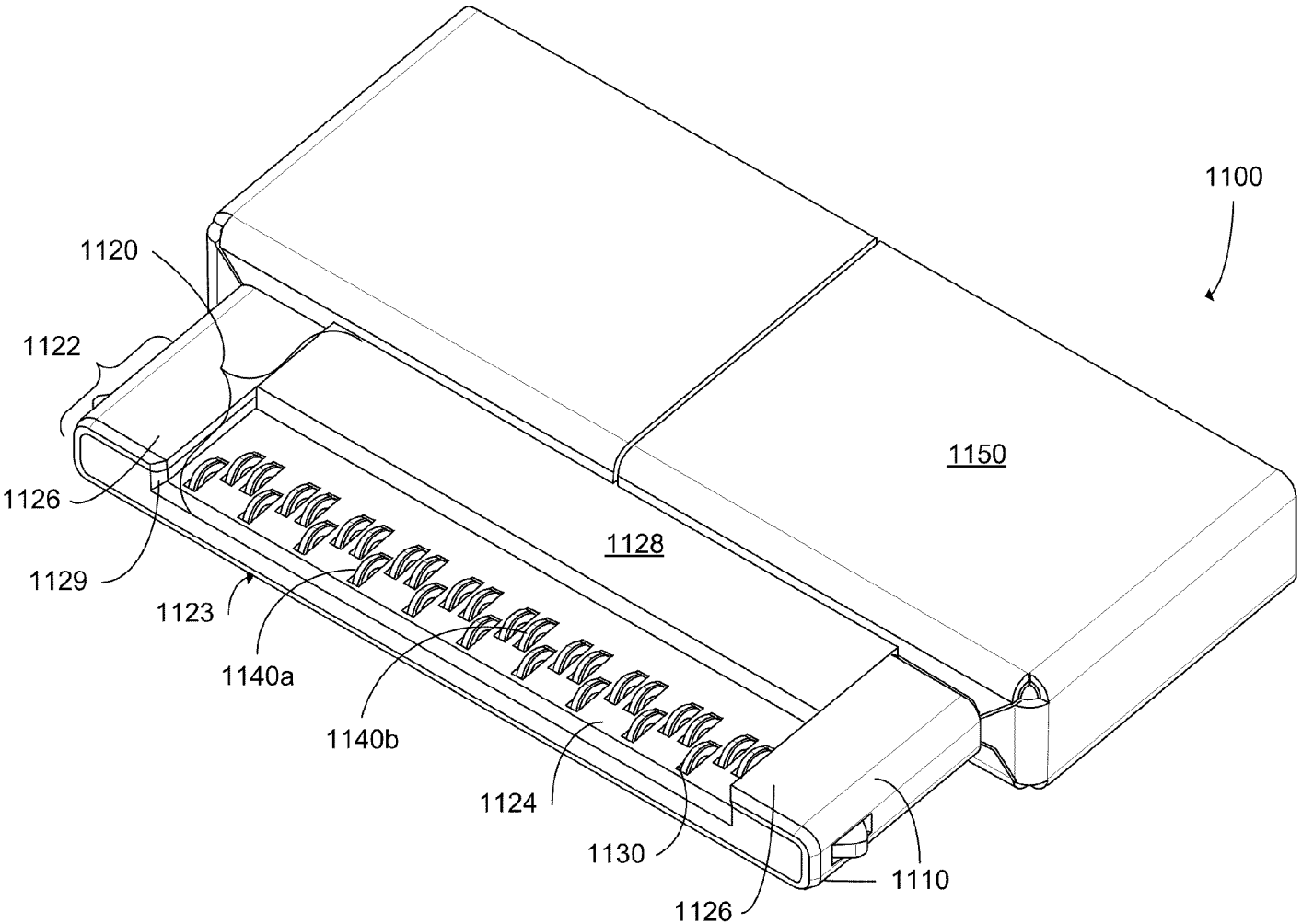
FIG. 11 illustrates a male plug connector 1100 with a reduced height according to embodiments of the present invention.

FIG. 11 illustrates a male plug connector 1100 with a reduced height according to embodiments of the present invention. In one aspect, a shell may not cover contacts of male plug connector 1100, thereby providing a slimmer connector.

Male plug connector 1100 can include a housing 1120 that is designed to accommodate a plurality of contacts spaced apart in a single row. The contacts may be staggered within this single row. A front end 1122 can be inserted into a receptacle connector (e.g. connector 1000). As front end 1122 is inserted into the receptacle connector, front end 1122 may be referred to as an insert.

A central bottom surface 1124 of front end 1122 includes a plurality of contact locations 1130, at which a plurality of contacts 1140 may reside. The bottom surface 1124 is central in that is resides between two lateral bottom surfaces 1126. Front end 1122 also has a top surface (which would be on the bottom of the figure as drawn). The use of bottom and top surfaces are used with reference to a receptacle connector whose insulator core is adjacent to a bottom surface of a shell (e.g. in embodiments shown in FIG. 10). Accordingly, the male plug connector would be inserted with the contacts pointing down, and thus for illustrative purposes, the surfaces 1124 and 1126 are described as being bottom surfaces.

Lateral bottom surfaces 1126 can be raised relative to central bottom surface 1124. A chamfer 1129 on a front of the inner wall between surfaces 1124 and raised surface 1126 may be used to provide alignment with an insulator core during mating. In one embodiment, chamfer 1129 has a 45 degree angle with respect to the side wall extending from central bottom surface 1124 to a lateral bottom surface. This alignment feature is discussed in more detail below. In another embodiment, the central bottom surface extends to a lateral edge of front end 1122, and this lateral bottom surfaces are not present.

In some embodiments, a shell 1110 can cover the top surface of front end 1122 and can cover lateral bottom surfaces 1126. However, in one embodiment, shell 1110 does not cover central bottom surface 1124. In another embodiment, shell 1110 does not cover the two lateral bottom surface 1126, or covers only a portion. The section of shell 1110 covering the top surface of the front end of the housing can have holes that engage tabs of the receptacle connector when the front end of the male plug connector is inserted into the receptacle connector.

In one embodiment, a step 1128 extends from central bottom surface 1124. As shown, step 1128 is located behind central bottom surface 1124 towards a back end of housing 1120. Housing 1120 may proceed further into the back of the connector 1100 into a base section 1150. Step 1128 may extend past a cavity of the receptacle connector when front end 1122 of male plug connector 1100 is inserted into the receptacle connector. For example, step 1128 may come in contact with an insulator core (e.g. 1020) when front end 1122 is fully inserted. Thus, step 1128 may mark a back edge of front end 1122.

In some embodiments (and as shown), contact locations 1130 are staggered with a first portion located at a first distance from a front edge 1123 of front end 1122 of housing 1120 and a second portion of the contact locations located at a second distance from front edge 1123. As shown, the second distance is larger than the first distance. In some embodiments, contact locations 1130 include holes in central bottom surface 1124 of housing 1120. Each hole may be configured to receive a section of a contact, which is exposed through the hole Ground contacts 1140*a* may be placed at the first portion of contact locations that are closer to front edge 1123 relative to signal and power contacts 1140*b*. In various embodiments of the present invention, other pins may be moved closer as well. For example, the DisplayPort hot connect detect pin may be moved closer to the front of the insert as well. Accordingly, male plug connector 1100 can ensure that ground connections are made before signal and power connections, thereby electrically protecting the electronic device and a device connected to the electronic device. Since contacts on the male plug connector 1000 are staggered, contacts on a corresponding receptacle connector can be of a same length. Thus, the corresponding receptacle connector can be of a reduced depth.

In an embodiment that uses the contact designation 400 of FIG. 4, the first portion of the contact locations can be separated from each other by two contact locations of the second portion. Thus, if ground contacts 1140*a* are placed at the first portion of contact locations and signal contacts 1140*b* (which may include power signals) are placed at the second portion of contact locations, each ground contact may be separated from another ground contact by two signal contacts. In one embodiment, the number of ground contacts is nine. In another embodiment, the signal contacts include a first set of signal contacts for carrying USB 3.0 signals and a second set of signal contacts for carrying DisplayPort signals.

In FIG. 11, a contact 1140 is shown at each contact location 1130. However, in various embodiments, one or more of these contacts may be absent. For example, male plug connector 1100 may reduced functionality relative to a total functionality that may be provided to a receptacle connector. For example, only power and ground contacts may be used when male plug connector is used as part of a charger. As another example, only contacts for audio signals and audio ground may be present. Accordingly, in some situations, some contacts may not be needed, and may be omitted consistent.

When a male plug connector is inserted into a receptacle connector according to an embodiment of the present invention, it is important that the connector insert can only be inserted into the receptacle connector correctly. That is, it is important that the male plug connector cannot be inserted into the receptacle connector in an upside down manner. To prevent such an accidental insertion, embodiments of the present invention employ keying using the contact insulator core of a receptacle connector and insert of the male plug connector. If a male plug connector is inserted upside-down, a housing contacts an insulator core, which prevents the insert from proceeding further. An example of this is shown in the following figure.

Figure 12:
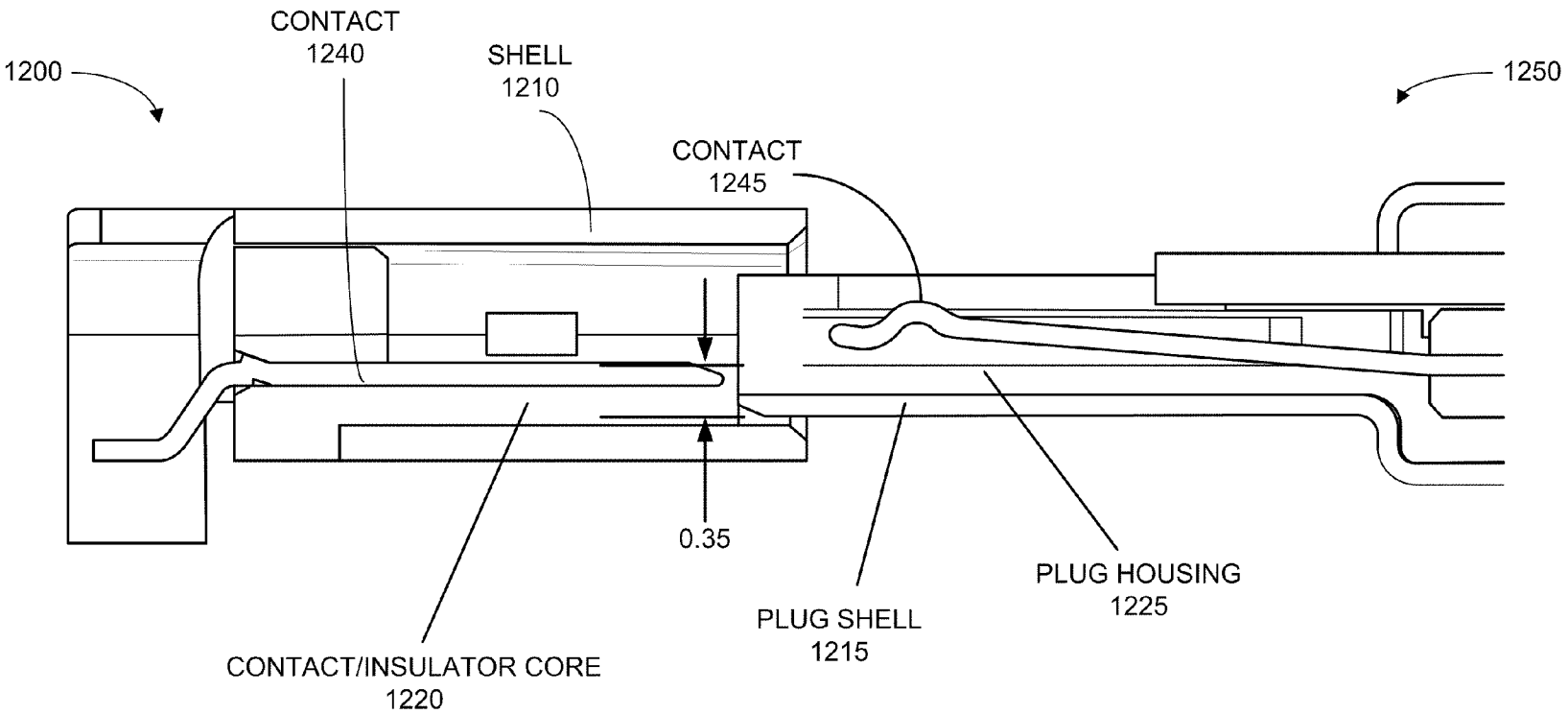
FIG. 12 illustrates keying aspects of connectors to prevent accidental inverted insertion of a male plug connector 1250 into a receptacle connector 1200 according to embodiments of the present invention.

FIG. 12 illustrates keying aspects of connectors to prevent accidental inverted insertion of a male plug connector 1250 into a receptacle connector 1200 according to embodiments of the present invention. Receptacle connector 1200 can include an insulator core 1220 on which contact 12450 is located. Insulator core 1220 can be adjacent to a bottom of a shell 1210. Male plug connector 1250 can include a housing 1225 that contains a contact 1245. A plug shell 1215 can cover a top surface of housing 1225.

In this figure, an attempt is made to the insert male plug connector 1250 upside-down into receptacle connector 1200. Upon this incorrect insertion, plug shell 1215 makes contact with the contact insulator core 1220, thus preventing continued insertion. In one embodiment, contact 1240 is recessed from the front of the contact insulator core 1220 to protect it during an improper insertion attempt.

It is also important that a male plug connector fit correctly with a limited amount of play in a receptacle connector. If there is a misalignment or play in the fit, contacts may lose contact or form undesirable connections. Accordingly, embodiments of the present invention provide accurate alignment for the connection of male plug connectors with receptacle connectors. Alignment can be achieved on a macro and micro level.

Figure 13:
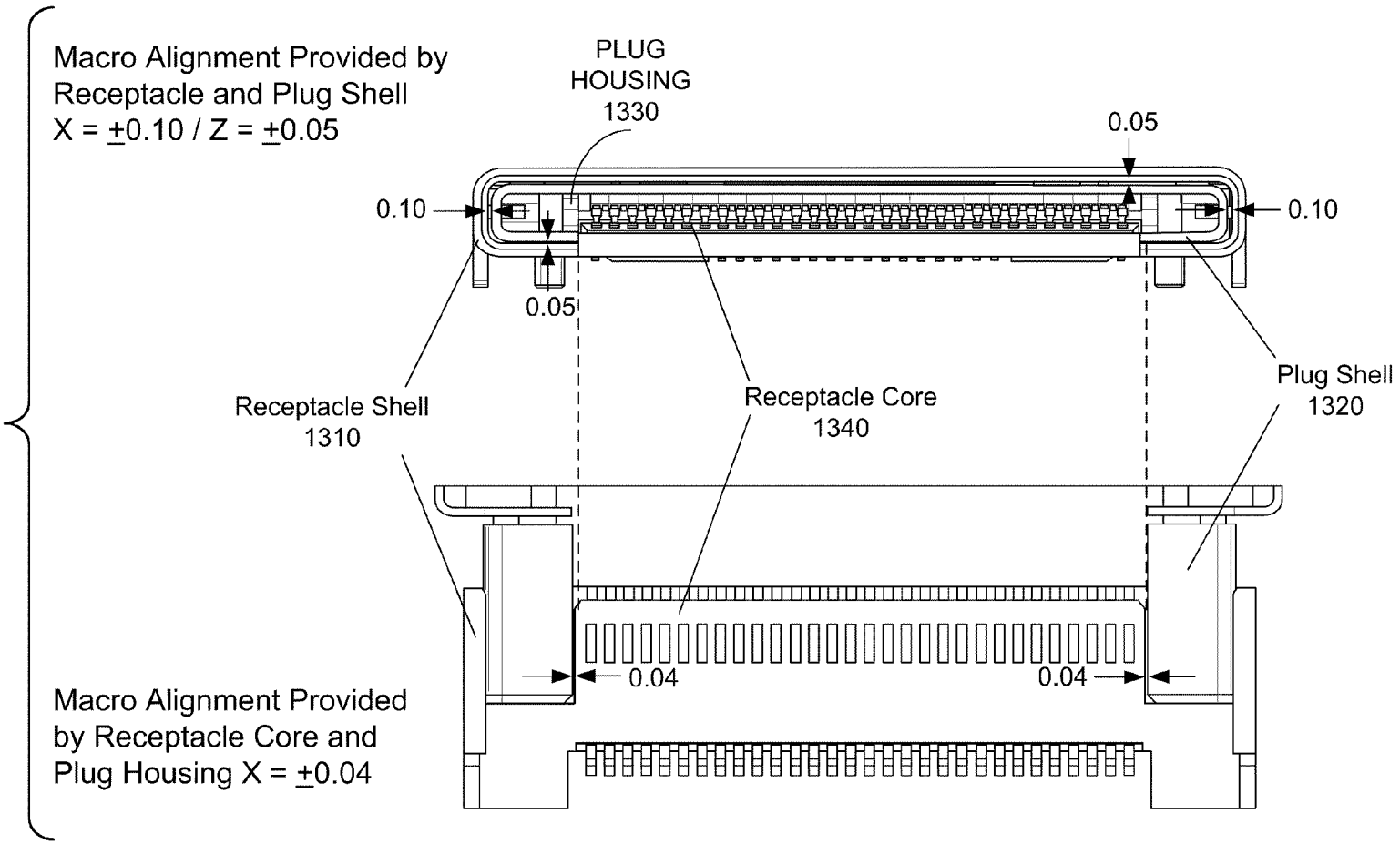
FIG. 13 illustrates mechanisms for aligning a male plug connector with a receptacle connector according to an embodiment of the present invention.

FIG. 13 illustrates mechanisms for aligning a male plug connector with a receptacle connector according to an embodiment of the present invention. FIG. 13 shows the connectors mated. A front view and a cross-sectional aerial view are shown.

In this example, macro-alignment can be provided by a receptacle connector shell 1310 and a male plug connector shell 1320. An outer width of male plug connector shell 1320 is less than an inner width of receptacle connector shell 1310, and a height of male plug connector shell 1320 is less than a height of a cavity of receptacle connector shell 1310. Thus, male plug connector shell 1320 can fit inside receptacle connector shell 1310. The widths can be manufactured with a tolerance that provides a space of up to 0.10 mm between the sides of the shells. The heights can be manufactured with a tolerance that provides a space of up to 0.05 mm between the shells on the top and bottom.

Micro-alignment can be provided by a receptacle connector core 1340 and a plug housing 1330 having a recess. For example, housing 1330 can have a recess with a width defined by raised lateral surfaces at the ends of a central bottom surface containing contacts, e.g., as described for FIG. 11. When inserted with a proper orientation, a width of the receptacle core 1340 is smaller than a width of the recess in plug housing 1330. Thus, receptacle core 1340 can fit inside the recess in plug housing 1330.

In one embodiment, these widths for micro-alignment are manufactured with a tolerance that provides a space of up to 0.04 mm between the sides of the shells. In one aspect, the insulator materials of receptacle connector core 1340 and plug housing 1330 can be machined with higher tolerances than the materials of the shells, and thus are used for the micro-alignment.

In one embodiment, receptacle connector core 1340 includes a chamfer (e.g. 1029 of FIG. 10) at each end of a front surface, and plug housing 1330 has a chamfer (e.g. 1129 of FIG. 11) at each front edge of the side walls defining the recess. When the male plug connector is inserted with a proper orientation into the receptacle connector, the chamfers on one edge meet and cause plug housing 1330 to slide into proper alignment. For example, the chamfer of the receptacle connector can be sloped (e.g. at 45 degrees) to push a lateral bottom surface and/or edge of a plug shell 1320 of the male plug connector outward to a side edge of receptacle core 1340. The chamfer of the male plug connector can push a side edge of receptacle core 1340 inward to a side wall extending from a central bottom surface to a lateral bottom surface of the male plug connector. In one embodiment, the angles of the corresponding chamfers can be complementary in that they sum up to 90 degrees, but have different values (e.g. 40 degrees and 60 degrees).

Figure 14A:
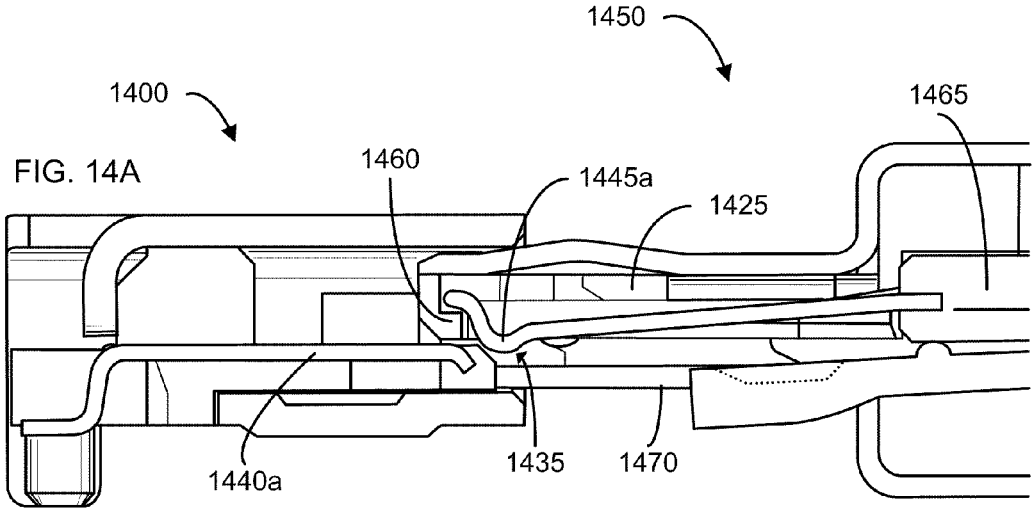
FIGS. 14A-14C illustrate cross-sectional side views of different stages during an insertion of a male plug connector into a receptacle connector according to embodiments of the present invention.
Figure 14B:
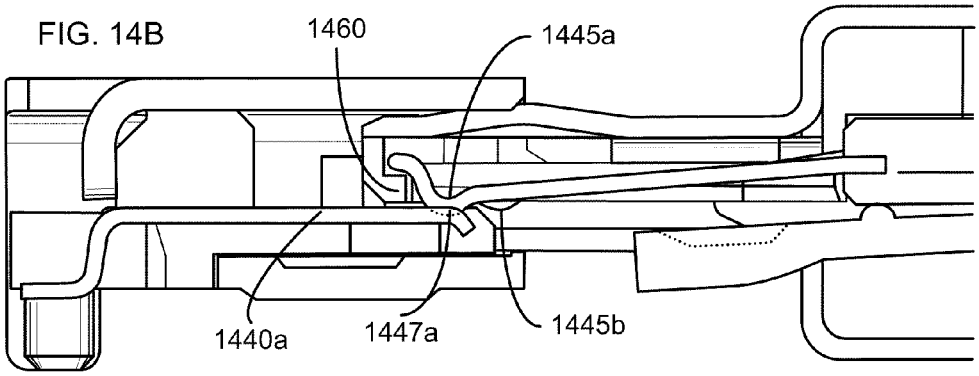
Figure 14C:
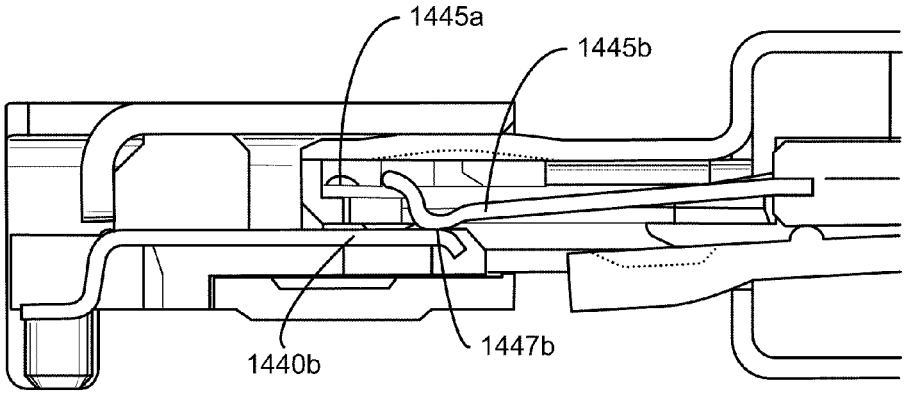

FIGS. 14A-14C illustrate cross-sectional side views of different stages during an insertion of a male plug connector 1450 into a receptacle connector 1400 according to embodiments of the present invention. FIG. 14A shows male plug connector 1450 at a beginning of insertion into receptacle connector 1400, and FIGS. 14B and 14C show male plug connector 1450 at later stages of insertion. For these figures, forward describes the direction that is depicted to the left on the paper.

In one embodiment, ground contacts of male plug connector 1450 can be located forward relative to other contacts in order to engage corresponding contacts of the receptacle connector first (e.g. as described for FIG. 11). As the ground contacts in male plug connector 1450 can be moved forward, the contacts of receptacle connector 1400 can be made a same length and shorter than if the grounds contacts were longer. This configuration can maintain ground as a make-first break-last connection, while also reducing the depth of receptacle connector 1400.

FIG. 14A shows male plug connector 1450 at an initial point of mating with receptacle connector 1400. Ground contact 1445*a* of male plug connector 1450 has not reached ground contact 1440*a* of receptacle connector 1400 yet. In one embodiment, ground contact 1445*a* can be a spring-loaded contact. For example, a middle section of ground contact 1445*a* can protrude through a contact location 1435, which may be a hole. A front section of ground contact 1445*a* can hook into a slot 1460 that anchors the front section. A back section of ground contact 1445*a* can extend from contact location 1430 to a fixed location at an insulator core 1465. Ground contact 1445*a* is allowed to be pushed up like a spring as it may be fixed only at the ends shown. Other contacts can be positioned in a similar manner.

In one embodiment, male plug connector 1450 includes a moveable door 1470, which may slide back or otherwise retract during insertion. Moveable door 1470 can provide protection of contacts of male plug connector 1450 when male plug connector 1450 is not inserted into receptacle connector 1400. Moveable door 1470 may cover a central bottom surface of housing 1425, where the central bottom surface can be located between two raised lateral surfaces as described above.

FIG. 14B shows ground contact 1445*a* of male plug connector 1450 at an initial contact point 1447*a* with ground contact 1440*a* of receptacle connector 1400. Male plug connector 1450 has moved further forward into receptacle connector 1400. As an example, ground contact 1445*a* may have touched a top elbow of ground contact 1440*a* and slid up on top of contact 1445*a*. Moveable door 1470 is shown as having slid further open as male plug connector 1450 has moved into a position of further insertion.

A signal contact 1445*b* lies in a staggered contact location that is further back than the contact location for ground contact 1445*a*. Thus, signal contact 1445*b* has not touched a contact of receptacle connector yet. Accordingly, ground contact 1445*a* is able to provide a make-first break-last connection.

FIG. 14C shows a signal contact 1445*b* of male plug connector 1450 at an initial contact point 1447*b* with ground contact 1440*b* of receptacle connector 1400. Ground contact 1445*a* is shown in front of signal contact 1445*b*. Ground contact 1445*a* is still contacting ground contact 1440*a*, but at a point further toward the back of receptacle connector 1400. Moveable door 1470 has slid further open as male plug connector 1450 has moved even further into receptacle connector 1400.

In one embodiment, besides allowing a reduced depth of receptacle connector 1400, the placement and structure of the contacts 1440 in receptacle connector 1450 can provide for better signal quality. The front section of contact 1445 (i.e. forward from contact point 1447) can act as an antenna, which can receive noise, thereby causing poor signal or ground quality. In one embodiment, the middle section of a contact 1445 can be provided with a tight bend and the front section can be made short so as to reduce the antenna behavior of the front section of contact 1145. Additionally, the lengths of each contact 1445 forward from each respective contact point 1447 can be made the same and to have a same shape. Thus, even though the front sections may act as an antenna and receive noise, the level of noise may be equal. With equal levels of noise, the effect from the noise may cancel, and good signal quality may be achieved.

The antenna behavior may also result from a length between contact point 1447*a* to a front of contact 1440*a*, which may be longer than the length between contact point 1447*b* to a front of contact 1440*b*. However, such antenna behavior will be smaller than that of a front section of contact 1445 as contacts 1440 are embedded in an insulator, which will shield contacts 1440. Also, in cases where receptacle connector 1400 is part of an electronic device, the ends of contacts 1440 are farther away from internal circuitry of the electronic device, which can be a source of electrical noise. Accordingly, since such length is at a front of the connector, it is not as susceptible to noise.

Additionally, in one embodiment, the length that a signal travels along the contacts from the back of one connector to the back of the other connector can be made the same for each set of corresponding contacts. For example, although the contact point 1447*a* is further forward than contact point 1447*b* (making the signal length on contacts 1447*a* smaller), contact 1445*a* may be made longer than contact 1445*b* to account for the difference. Besides being longer, contact 1445*a* can have a slightly different shape to account for the fact that the signal is on the contact 1445*a* (which is on an angle) for a longer distance than on contact 1445*b*. The shape can also account for the extra distance that a signal spends on contact 1440*b* than on contact 1440*a*.

Figure 15:
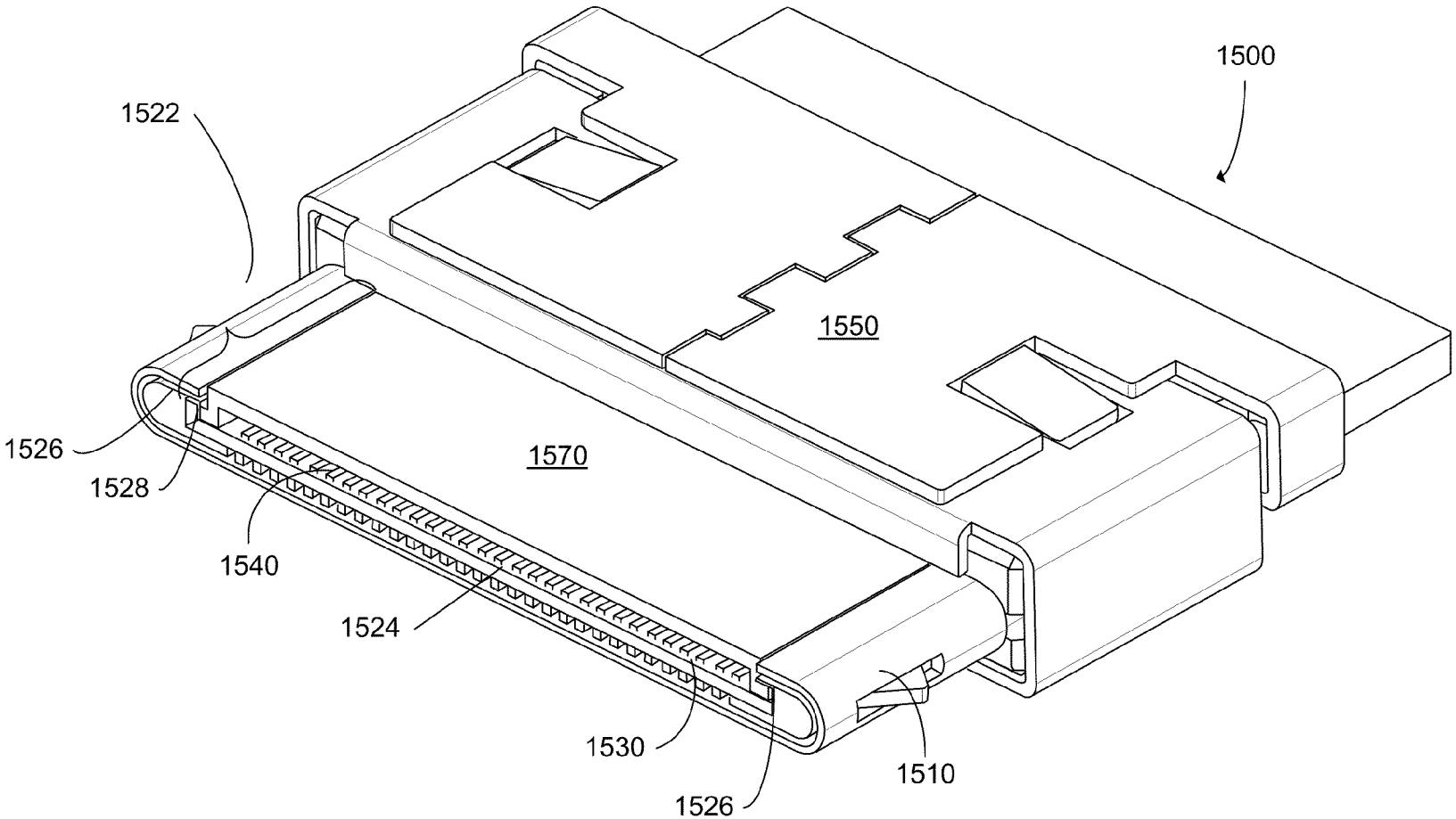
FIG. 15 illustrates a male plug connector 1500 with a reduced height and a moveable door 1 according to embodiments of the present invention.

FIG. 15 illustrates a male plug connector 1500 with a reduced height and a moveable door 1570 according to embodiments of the present invention. Male plug connector 1500 can have some of the same or similar features as other male plug connectors mentioned herein.

Male plug connector 1500 can include a housing that is designed to accommodate a plurality of contacts spaced apart in a single row. An insert 1522 can be inserted partially or completely into a receptacle connector (e.g. connector 1000). A central bottom surface 1524 of insert 1522 includes a plurality of contact locations 1530, at which a plurality of contacts 1540 may reside. Central bottom surface 1524 resides between two lateral bottom surfaces 1526.

Moveable door 1570 can cover contacts 1540 when male plug connector 1500 is not inserted into a corresponding receptacle connector. In one embodiment, moveable door can slide back into base 1550. For example, upon insertion, moveable door 1570 can come in contact with an insulator core of the corresponding receptacle connector. As insert 1522 moves forward, the insulator core can push moveable door 1570 into base 1550, thereby exposing contacts 1540 so that they may come in contact with contacts of the corresponding receptacle connector. In another embodiment, a user can move the moveable door 1570 prior to insertion.

In one embodiment, lateral bottom surfaces 1526 can be raised relative to central bottom surface 1524 and extend past a wall 1528, thereby creating a groove that moveable door 1570 can be guided by as it moves. Wall 1528 can have a chamfer located at the front, which may be used to provide alignment with an insulator core during mating. In some embodiments, a shell 1510 can cover a top surface of insert 1522 and can cover lateral bottom surfaces 1526.

Embodiments described herein can provide male plug connectors and female receptacle connectors that can be of a reduced size and support high-speed communication standards, such as USB 3.0 and DisplayPort. In some embodiments, a receptacle connector has an insulator core adjacent to a surface of a shell to reduce a height of the connector. In other embodiments, contacts of a connector are provided with a shape that helps to provide a retention force to hold the contact within an insulator while providing good signal quality, even at a reduced contact pitch. Other embodiments can provide alignment when mating the connectors, reduced depth of the receptacle connector, and reductions in noise.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A connector comprising:

a housing designed to accommodate a plurality of contacts, the housing including a plurality of contact locations for locating the plurality of contacts, wherein the plurality of contact locations include a first set of contact locations designated for USB 3.0 signals and a second set of contact locations designated for DisplayPort signals;

a first set of signal contacts disposed at the first set of contact locations, the first set of signal contacts configured to carry the USB 3.0 signals; and a second set of signal contacts disposed at the second set of contact locations, the second set of signal contacts configured to carry the DisplayPort signals.

2. The connector of claim 1, wherein the plurality of contact locations are spaced apart in a row.

3. The connector of claim 2, wherein the first set of contact locations designated for USB 3.0 signals are located along the row before the second set of contact locations designated for DisplayPort signals.

4. The connector of claim 1, wherein a contact for carrying ground is disposed between at least some of the signal contacts for carrying USB 3.0 signals and all of the signal contacts for carrying DisplayPort signals.

5. The connector of claim 4, wherein a level of crosstalk between data signals on the signal contacts is less than 3%.

6. The connector of claim 4, wherein an impedance of the signal contacts for carrying USB 3.0 signals is 90 Ohms plus or minus 10%, and wherein an impedance of the signal contacts for carrying DisplayPort signals is 100 Ohms plus or minus 10%.

7. The connector of claim 1, wherein the signal contacts for carrying USB 3.0 signals for transmitting are located next to each other on a substrate, and wherein the signal contacts for carrying USB 3.0 signals for receiving are located next to each other on a substrate.

8. The connector of claim 1, wherein the connector is a male plug connector for connecting to a corresponding female receptacle connector.

9. The connector of claim 1, wherein the connector is a female receptacle connector for connecting to a corresponding male plug connector.

10. An electronic device comprising the female receptacle connector of claim 9.

11. A connector comprising:

a housing designed to accommodate contacts in sequentially numbered contact locations, the housing including:

a first set of contact locations designated for DisplayPort signals, wherein the first set of contact locations includes two auxiliary contact locations for a DisplayPort auxiliary channel, the two auxiliary contact locations being in consecutively numbered contact locations; and a first set of contacts disposed at the first set of contact locations, the first set of contacts configured to carry the DisplayPort signals.

12. The connector of claim 11, wherein the first set of contact locations further include:

a hot plug detect contact location that is at a contact location consecutive with the two auxiliary contact locations, the hot plug detect contact location designated for a hot plug detect signal.

13. The connector of claim 12, further comprising a contact at the hot plug detect contact location, the contact for carrying the hot plug detect signal, wherein the hot plug detect signal is used as an interrupt request.

14. The connector of claim 12, wherein the interrupt request is configured to enable a source device to detect when a sink device is attached.

15. The connector of claim 11, wherein the sequentially numbered contact locations lie in a single row on a surface of the housing.

16. The connector of claim 11, wherein the connector is a male plug connector for connecting to a corresponding female receptacle connector.

17. The connector of claim 11, wherein the connector is a female receptacle connector for connecting to a corresponding male plug connector.

18. An electronic device comprising the female receptacle connector of claim 17.

19. A method of using a connector having a housing designed to accommodate a plurality of contacts, the housing including a plurality of contact locations for locating the plurality of contacts, wherein the plurality of contact locations include a first set of contact locations designated for USB 3.0 signals and a second set of contact locations designated for DisplayPort signals, the method comprising:

transmitting the USB 3.0 signals over a first set of signal contacts disposed at the first set of contact locations; and transmitting the DisplayPort signals over a second set of signal contacts disposed at the second set of contact locations.

20. A method of using a connector having a housing designed to accommodate contacts in sequentially numbered contact locations, the housing including a first set of contact locations designated for DisplayPort signals, wherein the first set of contact locations includes two auxiliary contact locations for a DisplayPort auxiliary channel, the two auxiliary contact locations being in consecutively numbered contact locations, the method comprising:

transmitting the signals for the DisplayPort auxiliary channel over two auxiliary contacts disposed at the two auxiliary contact locations.

* * * * *

UNITED STATES PATENT AND TRADEMARK OFFICE

CERTIFICATE OF CORRECTION

PATENT NO. : 8,246,359 B2
APPLICATION NO. : 13/008761
DATED : August 21, 2012
INVENTOR(S) : Jason Sloey et al.

It is certified that error appears in the above-identified patent and that said Letters Patent is hereby corrected as shown below:

In the Claims:

Column 21, line 14, please delete "claim 12" and insert --claim 13--.

Signed and Sealed this
Thirteenth Day of November, 2012

David J. Kappos

David J. Kappos
*Director of the United States Patent and Trademark Office*